US008330689B2

(12) United States Patent
Morisue et al.

(10) Patent No.: US 8,330,689 B2
(45) Date of Patent: Dec. 11, 2012

(54) TRANSMISSIVE LIQUID CRYSTAL DISPLAY DEVICE HAVING CONTROL SECTION FOR CONTROLLING EMISSION LUMINANCE OF BACKLIGHT

(75) Inventors: Takashi Morisue, Nara (JP); Tsuyoshi Muramatsu, Nara (JP); Atsushi Aoki, Nara (JP); Hiroshi Tanaka, Soraku-gun (JP)

(73) Assignee: Sharp Kabushiki Kaisha, Osaka (JP)

( * ) Notice: Subject to any disclaimer, the term of this patent is extended or adjusted under 35 U.S.C. 154(b) by 1094 days.

(21) Appl. No.: 12/238,113

(22) Filed: Sep. 25, 2008

(65) Prior Publication Data

US 2009/0085847 A1 Apr. 2, 2009

(30) Foreign Application Priority Data

Sep. 27, 2007 (JP) ..... 2007-252701

(51) Int. Cl.
*G09G 3/36* (2006.01)

(52) U.S. Cl. ..... 345/88

(58) Field of Classification Search ..... 345/88
See application file for complete search history.

(56) References Cited

U.S. PATENT DOCUMENTS

| | | | | |
|---|---|---|---|---|
| 6,965,389 | B1 | 11/2005 | Masuji et al. | |
| 7,277,075 | B1 | 10/2007 | Hirano et al. | |
| 2003/0222884 | A1 | 12/2003 | Ikeda et al. | |
| 2005/0140622 | A1 | 6/2005 | Lee et al. | |
| 2005/0285828 | A1 | 12/2005 | Inoue et al. | |
| 2006/0274026 | A1* | 12/2006 | Kerofsky | 345/102 |
| 2007/0064162 | A1 | 3/2007 | Yamamoto et al. | |
| 2008/0088649 | A1 | 4/2008 | Ikeno et al. | |
| 2008/0150863 | A1* | 6/2008 | Morisue et al. | 345/102 |
| 2008/0180384 | A1* | 7/2008 | Aoki et al. | 345/102 |
| 2008/0198180 | A1 | 8/2008 | Lagendijk | |
| 2009/0046046 | A1 | 2/2009 | Mamba et al. | |
| 2009/0273607 | A1 | 11/2009 | Ueki et al. | |

FOREIGN PATENT DOCUMENTS

| | | | |
|---|---|---|---|
| JP | 1-222967 | A | 6/1989 |
| JP | 11-065531 | | 3/1999 |
| JP | 2001-119715 | A | 4/2001 |
| JP | 2001-147666 | A | 5/2001 |
| JP | 2004-54250 | A | 2/2004 |
| JP | 2005-196175 | A | 7/2005 |
| JP | 2006 133711 | A | 5/2006 |
| JP | 2007-3848 | A | 1/2007 |

(Continued)

OTHER PUBLICATIONS

U.S. Appl. No. 12/238,029, filed Sep. 25, 2008 entitled "Transmissive Liquid Crystal Display Device".

(Continued)

*Primary Examiner* — William Boddie
*Assistant Examiner* — Andrew Schnirel
(74) *Attorney, Agent, or Firm* — Nixon Vanderhye P.C.

(57) ABSTRACT

In a transmissive liquid crystal display device including a liquid crystal panel and a backlight, the liquid crystal panel contains pixels each divided into four subpixels, a red (R), a green (G), a blue (B), and a white (W) subpixel. The backlight is a white backlight emitting light with controllable emission luminance. A luminance lowering section performs luminance lowering processing on input RGB signals (original input signals) for transformation into luminance-lowered RGB signals. An output signal generating section obtains transmittances and a backlight value from the luminance-lowered RGB signals.

14 Claims, 15 Drawing Sheets

FOREIGN PATENT DOCUMENTS

| | | | |
|---|---|---|---|
| JP | 2007-10753 | A | 1/2007 |
| JP | 2008-122940 | A | 5/2008 |
| JP | 2008-176247 | A | 7/2008 |
| JP | 2009-500654 | A | 1/2009 |
| JP | 2009-47775 | A | 3/2009 |
| WO | 01/37249 | A2 | 5/2001 |
| WO | 2007/004194 | A2 | 1/2007 |
| WO | 2007/039957 | A1 | 4/2007 |

OTHER PUBLICATIONS

Office Action from U.S. Appl. No. 12/238,029 dated Mar. 29, 2012; Morisue.

Office Action from U.S. Appl. No. 12/238,029 dated Aug. 31, 2012; Morisue.

* cited by examiner

FIG. 5 (a)

Input Signals (Ry[i], Gy[i], By[i])

| | |
|---|---|
| A : (200, 200, 190) | B : (180, 100, 80) |
| C : (130, 150, 70) | D : (100, 120, 80) |

FIG. 5 (b)

Transmission Amount (Rty[i], Gty[i], Bty[i])

| | |
|---|---|
| A : (100, 100, 90, 100) | B : (100, 20, 0, 80) |
| C : (60, 80, 0, 70) | D : (40, 60, 20, 60) |

FIG. 5 (c)

Backlight Value for Each Pixel

| | |
|---|---|
| A : 100 | B : 100 |
| C : 80 | D : 60 |

⇨ Backlight Value : 100

FIG. 5 (d)

Transmittances (ry[i], gy[i], by[i])

| | |
|---|---|
| A : (1.0, 1.0, 0.9, 1.0) | B : (1.0, 0.2, 0.0, 0.8) |
| C : (0.6, 0.8, 0.0, 0.7) | D : (0.4, 0.6, 0.2, 0.6) |

FIG. 5 (e)

Display Luminance

| | |
|---|---|
| A : (200, 200, 190) | B : (180, 100, 80) |
| C : (130, 150, 70) | D : (100, 120, 80) |

TRANSMISSIVE LIQUID CRYSTAL DISPLAY DEVICE HAVING CONTROL SECTION FOR CONTROLLING EMISSION LUMINANCE OF BACKLIGHT

This nonprovisional application claims priority under 35 U.S.C. §119(a) on Patent Application No. 2007-252701 filed in Japan on Sep. 27, 2007, the entire contents of which are hereby incorporated by reference.

FIELD OF THE INVENTION

The present invention relates to transmissive liquid crystal display devices constructed of a backlight and a liquid crystal panel.

BACKGROUND OF THE INVENTION

There exist various types of color display devices are available for commercial use. Thin-type display devices are divided into two main categories: self-luminous types like the PDP (plasma display panel) and non-luminous types like the LCD (liquid crystal display). A well-known subcategory of the LCD, a typical example of non-luminous type display devices, is the transmissive LCD containing a backlight behind a liquid crystal panel.

FIG. 16 is a cross-sectional view of a general structure of the transmissive LCD. The transmissive LCD includes a backlight 110 behind a liquid crystal panel 100. The liquid crystal panel 100 has a liquid crystal layer 103 between a pair of transparent substrates 101, 102. Polarizers 104, 105 are provided outside the transparent substrates 101, 102. The liquid crystal panel 100 has provided therein a color filter 106 to produce a color display.

The transparent substrate 101, 102 has provided therein an electrode layer and orientation films (not shown) so that the amount of light passing through the liquid crystal panel 100 can be controlled in terms of individual pixels by controlling application voltage to the liquid crystal layer 103. In other words, the transmissive LCD controls the display by controlling transmission through the liquid crystal panel 100 of the light emitted by the backlight 110.

The backlight 110 projects light including three wavelengths (RGB) necessary for the color display device. The backlight 110, used in conjunction with the color filter 106 to regulate individual transmittances for RGB light, enables arbitrary settings of luminance and hue as pixels. The backlight 110 is typically an electroluminescent (EL) lamp, a cold cathode fluorescent lamp (CCFL), a light emitting diode (LED), or another white light source.

In the liquid crystal panel 100, pixels are arranged to form a matrix with each pixel normally being composed of three subpixels as illustrated in FIG. 17. The subpixels are arranged to match a red (R), a green (G), or a blue (B) filter layer in the color filter 106. The subpixels will be referred to as R subpixels, G subpixels, and B subpixels throughout the following.

The R, G, B subpixels selectively transmit particular wavelengths (i.e., red, green, and blue) of the white light produced by the backlight 110 and absorb other wavelengths.

In the transmissive LCD constructed as above, the transmission through the liquid crystal panel 100 of the light emitted by the backlight 110 is controlled by the pixels in the liquid crystal panel 100; some of the light is inevitably absorbed by the liquid crystal panel 100. In addition, the R, G, B subpixels in the color filter 106 absorb the white light produced by the backlight 110 except for the particular wavelengths. These facts demonstrate that the liquid crystal panel and the color filter absorb much of incoming light in ordinary transmissive LCDs. That results in a low use efficiency for the light emitted by the backlight, which in turn leads to a problem of large power consumption by the backlight.

A known technique for reducing the power consumption by the transmissive LCD is a method involving use of an active backlight of which the luminance is adjustable according to an image being displayed. The technique is disclosed, for example, in Japanese Unexamined Patent Publication No. 65531/1999 (Tokukaihei 11-65531, published Mar. 9, 1999; "Patent Document 1").

Patent Document 1 employs an active backlight of which the luminance is adjustable and attempts to lower the power consumption by the backlight by controlling the display on the LCD (luminance control) through the control of the transmittance of the liquid crystal panel and the luminance of the active backlight.

In Patent Document 1, the luminance of the backlight is controlled to match a maximum luminance value of an input image (input signal). The transmittance of the liquid crystal panel is adjusted according to the thus controlled luminance of the backlight.

Under these conditions, the subpixels corresponding to the maximum input signal level exhibit a 100% transmittance. The other subpixels show 100% or lower transmittances as calculated in reference to the luminance of the backlight. Therefore, when the whole image is dark, the backlight is dimmed to reduce the power consumption by the backlight.

In this manner, in Patent Document 1, the brightness of the backlight is reduced to a minimum according to the input RGB signals for the input image. Meanwhile, the absorption of light by the liquid crystal panel is reduced by increasing the transmittance of the liquid crystal as much as the backlight is dimmed. The structure hence reduces the power consumption by the backlight.

The conventional structure indeed reduces the power consumption by the backlight by reducing the absorption by the liquid crystal panel. The structure however is unable to reduce the absorption of light by the color filter. If the absorption by the color filter is reduced, the power consumption is further reduced.

SUMMARY OF THE INVENTION

The present invention has an objective of providing a transmissive liquid crystal display device capable of reducing not only the absorption by the liquid crystal panel, but also the absorption by the color filter, for further power consumption reductions.

To achieve the objective, a transmissive liquid crystal display device of the present invention includes: a liquid crystal panel containing pixels each divided into four subpixels, a red (R), a green (G), a blue (B), and a white (W) subpixel; a white active backlight emitting light with controllable emission luminance; a luminance lowering section for performing luminance lowering processing on high luminance pixel data of pixel data contained in input RGB signals representing an input image to transform the input RGB signals to luminance-lowered RGB signals; an output signal generating section for generating transmittance signals for individual R, G, B, W subpixels in the pixels in the liquid crystal panel from the luminance-lowered RGB signals and also calculating a backlight value for the active backlight from the luminance-lowered RGB signals; a liquid crystal panel control section for controlling driving of the liquid crystal panel according to the transmittance signals generated in the output signal generating section; and a backlight control section for controlling the emission luminance of the backlight according to the backlight value calculated in the output signal generating section.

Another transmissive liquid crystal display device of the present invention includes: a liquid crystal panel containing pixels each divided into four subpixels, a red (R), a green (G), a blue (B), and a white (W) subpixel; a white active backlight emitting light with controllable emission luminance; a chroma lowering section for performing chroma lowering processing on high luminance, high chroma pixel data of pixel data contained in input RGB signals representing an input image to transform the input RGB signals to chroma-lowered RGB signals; a luminance lowering section for performing luminance lowering processing on high luminance pixel data of pixel data contained in the chroma-lowered RGB signals to transform the chroma-lowered RGB signals to chroma/luminance-lowered RGB signals; an output signal generating section for generating transmittance signals for individual R, G, B, W subpixels in the pixels in the liquid crystal panel from the chroma/luminance-lowered RGB signals and also calculating a backlight value for the active backlight from the chroma/luminance-lowered RGB signals; a liquid crystal panel control section for controlling driving of the liquid crystal panel according to the transmittance signals generated in the output signal generating section; and a backlight control section for controlling the emission luminance of the backlight according to the backlight value calculated in the output signal generating section.

According to the configuration, the liquid crystal panel in which each pixel is divided into four (R, G, B, and W) subpixels enables parts of the R, G, B components to the W subpixels in which there occurs no or little loss of light due to absorption by filters. That reduces the amount of light absorbed by the color filters, enabling equivalent reductions in the backlight value. Thus, the power consumption by the transmissive liquid crystal display device is reduced.

The input RGB signals (original inputs) are subjected to either luminance lowering processing or chroma and luminance lowering processing. The backlight value and the RGBW transmittances are calculated from the processed luminance-lowered RGB signals or chroma/luminance-lowered RGB signals. That ensures reduction in the backlight value.

The transmissive liquid crystal display device may include a plurality of the active backlights for the liquid crystal panel, wherein transmittance control for the liquid crystal panel and backlight value control for the backlights are performed for each of regions corresponding respectively to the active backlights.

According to the configuration, the multiple backlights enable an optimal backlight value to be determined for each of the backlight regions. The configuration thus reduces overall backlight power consumption.

BRIEF DESCRIPTION OF THE DRAWINGS

FIG. 3(*b*) illustrates how a backlight luminance value is obtained in Patent Document 1 for comparison.

FIG. 4(*b*) illustrates how a backlight luminance value is obtained in Patent Document 1 for comparison.

FIGS. 5(*a*) to 5(*e*) illustrate procedures to determine a backlight luminance value for the liquid crystal display device and a transmittance for subpixels.

DESCRIPTION OF THE EMBODIMENTS

The following will describe embodiments of the present invention in reference to drawings. First, the configuration of a liquid crystal display device in accordance with the present embodiment (the "present liquid crystal display device") will be described schematically in reference to FIG. 1.

The present liquid crystal display device includes a luminance lowering section 12, an output signal generating section 13, a liquid crystal panel control section 14, a RGBW liquid crystal panel (simply the "liquid crystal panel") 15, a backlight control section 16, and a white backlight (simply "backlight") 17.

Figure 2:
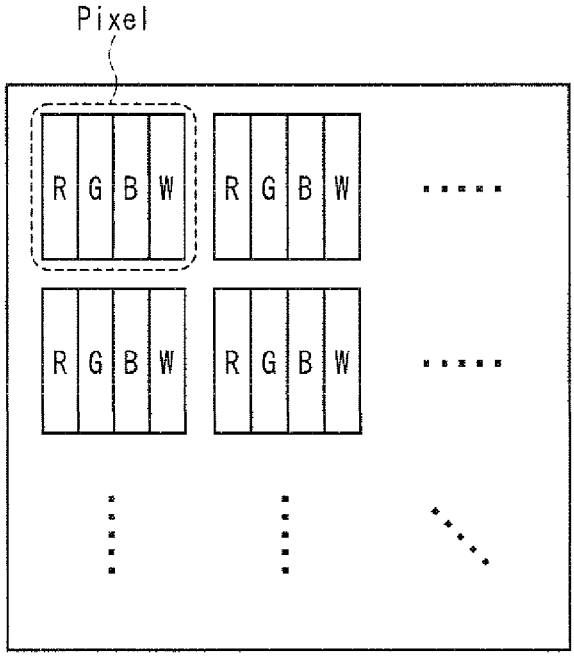
FIGS. 2(*a*), 2(*b*) each illustrate an example of subpixel arrangement in the transmissive liquid crystal display device.
Figure 2:
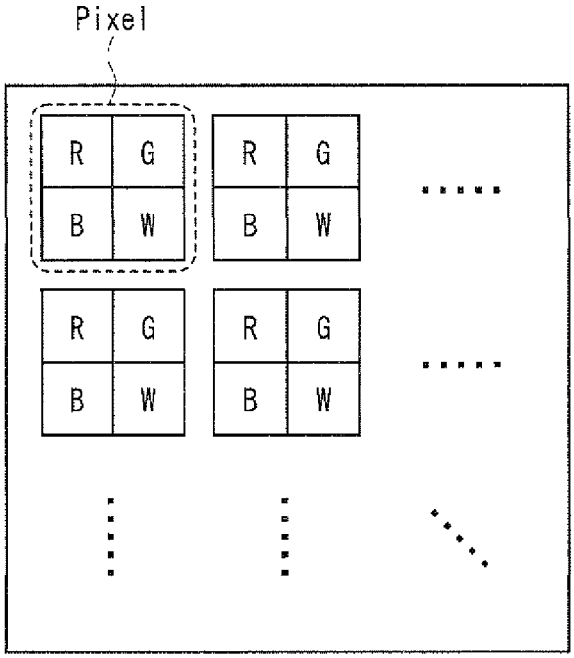

The liquid crystal panel 15 contains a matrix of Np pixels. Each pixel is made up of four subpixels as shown in FIGS. 2(*a*), 2(*b*): a R (red), a G (green), a B (blue), and a W (white) subpixel. The shape and relative positions of the R, G, B, W subpixels in each pixel are not limited in any particular manners. The backlight 17 is a white light source, which could be, for example, a cold cathode fluorescent lamp (CCFL) or a white light emitting diode (white LED). The backlight 17 is an active backlight for which the brightness of projection is controllable.

The R, G, B subpixels in the liquid crystal panel 15 are arranged to match respective R, G, B filter layers in the color filter (not shown). The R, G, B subpixels hence selectively transmit the R, G, B wavelengths of the white light produced by the backlight 17 and absorb other wavelengths. The W subpixels basically have no matching absorption filter layer in the color filter. The light hitting the W subpixels is not absorbed at all by the color filter and remains unchanged (white light) when it exits the liquid crystal panel 15. The W subpixels, however, may have a matching filter layer which absorbs less of the light produced by the backlight than the R, G, B color filters.

The present liquid crystal display device receives display image information as RGB signals from an external personal computer, television tuner, or similar device and processes the RGB signals as input RGB signals R[i], G[i], B[i] (i=1, 2, . . . , Np).

The luminance lowering section 12 performs luminance lowering processing on the input RGB signals (first input RGB signals) and after the luminance lowering processing, outputs luminance-lowered RGB signals (second input RGB signals) to the subsequent output signal generating section 13.

The output signal generating section 13 calculates a backlight value for the backlight 17 and RGBW subpixel transmittances for each pixel in the liquid crystal panel 15 from the luminance-lowered RGB signals. The output signal generating section 13 calculates a backlight value from the luminance-lowered RGB signals and transforms the luminance-lowered RGB signals to proper transmittance signals for the backlight.

The calculated backlight value is supplied to the backlight control section 16 where the luminance of the backlight 17 is adjusted according to the backlight value. The backlight 17 is built around a white light source, which could be, for example, a CCFL or a white LED, and adjustable to a brightness in proportion to the backlight value under the control of the backlight control section 16. The brightness of the backlight 17 is controlled by a method which differs depending on the type of light source used. Some exemplary brightness control methods involve applying a voltage in proportion to the backlight value or supplying a current in proportion to the backlight value. If the backlight is an LED, for example, the brightness can be controlled by changing the duty ratio by pulse width modulation (PWM). Furthermore, if the brightness of the backlight light source has a non-linear characteristic, the voltage applied or current supplied to the light source may be obtained from a desirable backlight value using a lookup table.

The transmittance signals generated by the output signal generating section 13 are fed to the liquid crystal panel control section 14 which based on the transmittance signals controls the liquid crystal panel 15 so that the individual subpixels can have a desired transmittance. The liquid crystal panel control section 14 contains a scan line drive circuit and a signal line drive circuit to generate scan signals and data signals. The section 14 drives the liquid crystal panel 15 by means of the scan signals, the data signals, and other panel control signals. The transmittance signals are used to generate the data signals in the signal line drive circuit. The liquid crystal panel 15 is controlled to show desired transmittance by applying a voltage in proportion to the transmittance of the subpixel or alternatively, to find the voltage to be applied to the liquid crystal panel from the desired subpixel transmittance in a lookup table and thus linearizing the non-linear characteristic.

In the liquid crystal display device of the present invention, the input signals are not limited to the RGB signals mentioned above and may be other color signals such as YUV signals. If the display device is fed with color signals other than RGB signals, the display device may first transform them to RGB signals before supplying them to the output signal generating section 13. Alternatively, the output signal generating section 13 may be adapted so that it can transform non-RGB color input signals to RGBW signals.

In the present liquid crystal display device, the display luminance of each subpixel in the liquid crystal panel 15 is given as the product of the brightness (projection luminance) of the backlight and the transmittance of the subpixel. Now, the following will describe in detail the display principles and power consumption reduction effect of the present liquid crystal display device. In the present liquid crystal display device, it is the output signal generating section 13 that calculates a backlight value and subpixel transmittances. Therefore, the following calculation method for a backlight value and subpixel transmittances is applied to the luminance-lowered RGB signals supplied from the luminance lowering section 12 to the output signal generating section 13. In the following description, the luminance-lowered RGB signal outputs of the luminance lowering section 12 are denoted by Ry[i], Gy[i], and By[i], the transmittance signals obtained by the output signal generating section 13 by ry[i], gy[i], and by[i], and the backlight value obtained by the output signal generating section 13 by Wbs.

According to the method of determining the backlight value and the subpixel transmittances for the present liquid crystal display device, a minimum backlight value is first obtained for each pixel in the display area corresponding to the backlight. The backlight values are obtained by either one of two methods depending on the display data for the individual pixels. Specifically, a backlight value for a pixel under consideration is obtained by one of two methods depending on the relationship between the maximum luminance (i.e., max(Ry[i], Gy[i], By[i])) and the minimum luminance (i.e., min(Ry[i], Gy[i], By[i])) of the subpixels of the pixel under consideration.

Figure 3:
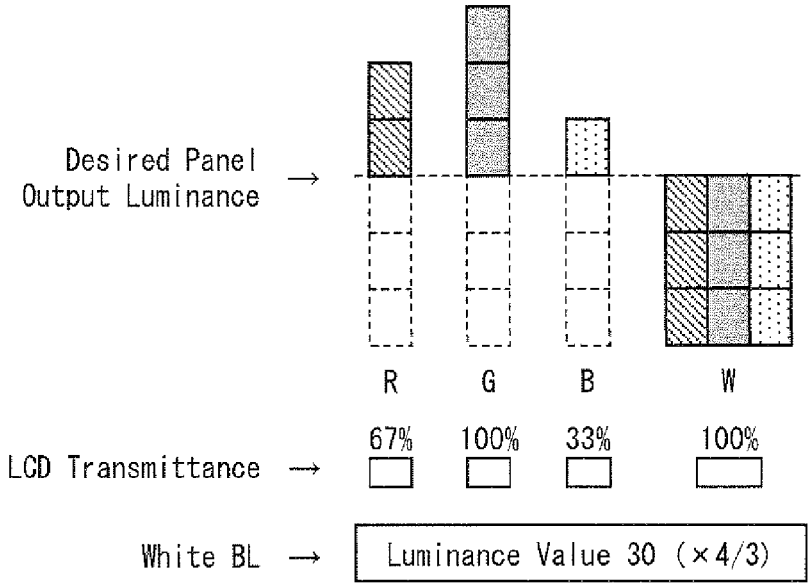
FIG. 3(*a*) illustrates how a backlight luminance value is obtained in the present liquid crystal display device.
Figure 3:
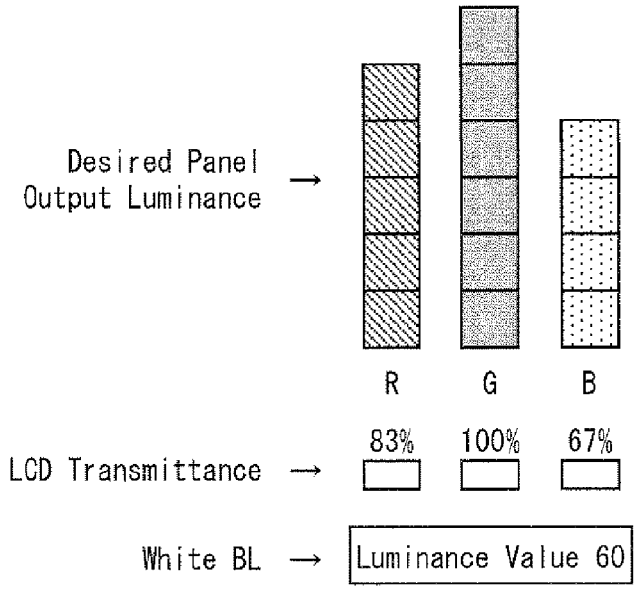

First, the method of obtaining a backlight value for a pixel in which min(Ry[i], Gy[i], By[i])≧max(Ry[i], Gy[i], By[i])/2 will be described in reference to FIGS. 3(*a*), 3(*b*). FIG. 3(*a*) illustrates how a backlight value is obtained in the present liquid crystal display device. FIG. 3(*b*) illustrates how a backlight value is obtained in Patent Document 1 for comparison.

Suppose in FIGS. 3(*a*), 3(*b*) that a pixel under consideration needs to achieve panel output luminance (R, G, B)=(50, 60, 40). The G luminance value, 60, is max(Ry[i], Gy[i], By[i]), the B luminance value, 40, is min(Ry[i], Gy[i], By[i]), and the relationship, min(Ry[i], Gy[i], By[i])≧max(Ry[i], Gy[i], By[i])/2, is satisfied.

In the display method of Patent Document 1, as illustrated in FIG. 3(*b*), the backlight luminance value is set to max(Ry[i], Gy[i], By[i])=60. The transmittances of the individual subpixels are determined from this backlight value. Therefore, the transmittances for the R, G, B subpixels are set respectively to 83% (=50/60), 100% (=60/60), and 67% (=40/60).

In contrast, the value corresponding to max(Ry[i], Gy[i], By[i])/2 in the R, G, B components of the input signals Ry[i], Gy[i], By[i] is given to the luminance value for the W component in the present liquid crystal display device. As a result, the input signals (R, G, B)=(50, 60, 40) given in RGB signal form are transformed to the output signals (R, G, B, W)=(20, 30, 10, 30) in RGBW signal form. The backlight luminance value is set to max(Ry[i], Gy[i], By[i])/2=30 for the pixel under consideration. The transmittances for the individual R, G, B, W subpixels are determined from the backlight value. Specifically, the transmittance for each subpixel is determined by (Output Luminance Value)/(Backlight Value). Therefore, the transmittances for the R, G, B, W subpixels are set respectively to 67% (=20/30), 100% (=30/30), 33% (=10/

30), and 100% (=30/30). FIG. 3(*a*) shows transmittances as an example for a case where the backlight value obtained for the pixel under consideration is the largest of the backlight values obtained for all the pixels and used as the luminance value for the backlight.

To compare the backlight value above for the present liquid crystal display device to the backlight value obtained by the method of Patent Document 1, the area ratio of the subpixels also need to be considered. Each pixel is divided into three subpixels in Patent Document 1, whereas each pixel is divided into four subpixels in the present liquid crystal display device. Therefore, the subpixel of the present liquid crystal display device has an area 3/4 that of Patent Document 1. The backlight luminance value for the present liquid crystal display device is increased by a factor of 4/3 to compensate for the difference in subpixel area, so that the backlight luminance value for the present liquid crystal display device and the backlight value obtained by the method of Patent Document 1 can be compared using a single standard.

As a result, correcting the backlight value in the example of FIG. 3(*a*) in view of the standard for the backlight value of FIG. 3(*b*) gives (4/3)×60/2=40. Since the backlight value in the example of FIG. 3(*b*) in which a similar display is produced is 60, it is understood that the present invention reduces the power consumption by the pixel under consideration.

Figure 4:
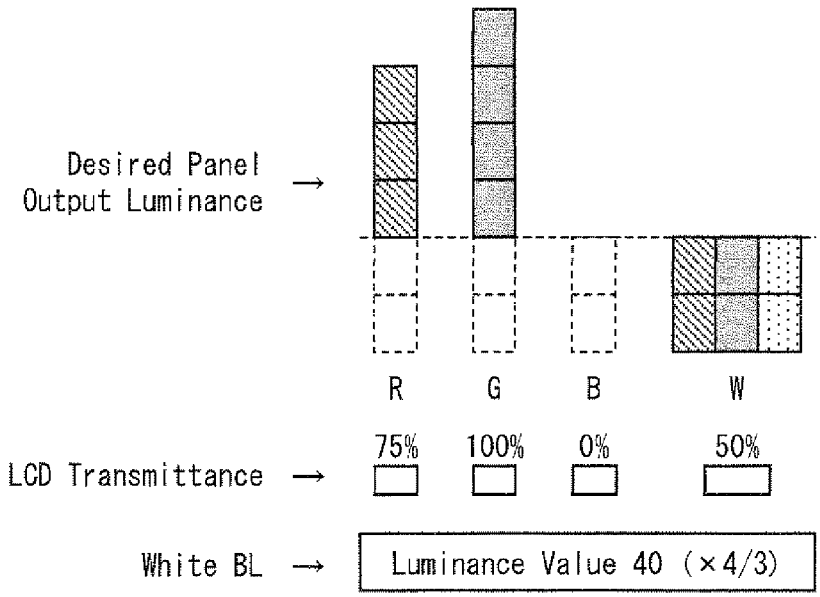
FIG. 4(*a*) illustrates how a backlight luminance value is obtained in the present liquid crystal display device.
Figure 4:
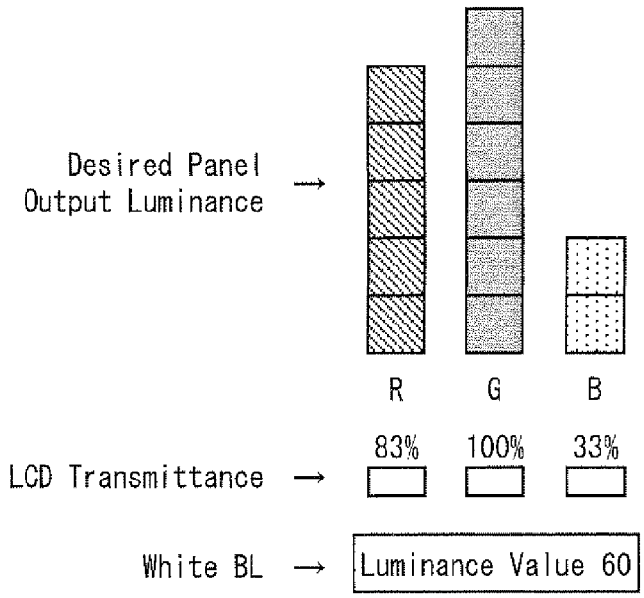

Next, the method of obtaining a backlight value for a pixel in which $$\min(Ry[i],Gy[i],By[i])<\max(Ry[i],Gy[i],By[i])/2$$

will be described in reference to FIGS. 4(*a*), 4(*b*). FIG. 4(*a*) illustrates how a backlight value is obtained in the present liquid crystal display device. FIG. 4(*b*) illustrates how a backlight value is obtained in Patent Document 1 for comparison.

Suppose in FIGS. 4(*a*), 4(*b*) that a pixel under consideration needs to achieve panel output luminance (R, G, B)=(50, 60, 20). The G luminance value, 60, is max(Ry[i], Gy[i], By[i]) the B luminance value, 20, is min(Ry[i], Gy[i], By[i]), and the relationship, $$\min(Ry[i],Gy[i],By[i])<\max(Ry[i],Gy[i],By[i])/2,$$

is satisfied.

In the display method of Patent Document 1, as illustrated in FIG. 4(*b*), the backlight luminance value is set to max(Ry[i], Gy[i], By[i])=60. The transmittances of the individual subpixels are determined from the backlight value. Therefore, the transmittances for the R, G, B subpixels are set respectively to 83% (=50/60), 100% (=60/60), and 33% (=20/60).

In contrast, the values corresponding to min(Ry[i], Gy[i], By[i]) in the R, G, B components of the input signals Ry[i], Gy[i], By[i] is given to the luminance value for the W component in the present liquid crystal display device. As a result, the input signals (R, G, B)=(50, 60, 20) given in RGB signal form are transformed to the output signals (R, G, B, W)=(30, 40, 0, 20) in RGBW signal form. The backlight luminance value is set to max(Ry[i], Gy[i], By[i])−min(Ry[i], Gy[i], By[i])=40 for the pixel under consideration. The transmittances for the individual R, G, B, W subpixels are determined from the backlight value. Specifically, the transmittance for each subpixel is determined by (Output Luminance Value)/(Backlight Value). Therefore, the transmittances for the R, G, B, W subpixels are set respectively to 75% (=30/40), 100% (=40/40), 0% (=0/40), and 50% (=20/40).

FIG. 4(*a*) shows transmittances as an example for a case where the backlight value obtained for the pixel under consideration is the largest of the backlight values obtained for all the pixels and used as the luminance value for the backlight. The backlight luminance value is again increased by a factor of 4/3 in the example of FIG. 4(*a*) so that the value can be compared using a single standard to the backlight value obtained by the method of Patent Document 1.

As a result, the backlight value in the example of FIG. 4(*a*) is (4/3)×(60−20)=53.3. Since the backlight value in the example of FIG. 4(*b*) in which a similar display is produced is 60, it is understood that the present invention reduces the power consumption by the pixel under consideration.

FIGS. 3(*a*), 3(*b*) and FIGS. 4(*a*), 4(*b*) detailed above depict how to obtain a necessary, but minimum backlight value for the individual pixels. A minimum backlight value is obtained for each pixel in the display area corresponding to the backlight according to these methods. Of the backlight values thus obtained, the largest one is designated as the luminance value for the backlight.

Now, the procedures for determining a backlight value and subpixel transmittances for the present liquid crystal display device carried out by the above methods will be described in reference to FIGS. 5(*a*) to 5(*e*).

FIG. 5(*a*) shows input signals (Ry[i], Gy[i], By[i]) for the display area corresponding to a backlight. For simple description, suppose here that the display area contains four pixels A to D.

FIG. 5(*b*) shows the result of the transform of the input signals (Ry[i], Gy[i], By[i]) to output signals (Rty[i], Gty[i], Bty[i], Wty[i]) in RGBW signal form for these pixels A to D. The backlight values obtained for the individual pixels are shown in FIG. 5(*c*). Accordingly, the backlight value for the backlight is set to the largest one of the backlight values obtained for the individual pixels, that is, 100.

In light of the backlight value 100, the transmittances for the pixels (Ry[i], Gy[i], By[i], Wy[i]) are obtained from the values of the output signals (Rty[i], Gty[i], Bty[i], Wty[i]) shown in FIG. 5(*b*). Results are shown in FIG. 5(*d*). The final display luminances for the pixels are shown in FIG. 5(*e*). It is confirmed that the final display luminances match the luminance values of the input signals (Ry[i], Gy[i], By[i]) shown in FIG. 5(*a*).

The calculation of the backlight value and subpixel transmittances above implemented by the output signal generating section 13 reduces absorption of light by the color filters by giving an amount of white component to the W subpixels, so as to reduce the power consumption by the backlight 17. For these reasons, display image data needs to be such that an amount of white component can be given to W subpixels. This condition is essential in achieving a reduction in backlight power consumption.

In other words, the calculation of the backlight value and subpixel transmittances by the output signal generating section 13 results in giving a large amount of white component to the W subpixel in all pixels in the display area corresponding to the backlight (that is, if the chroma is low), the backlight power consumption is reduced by large amounts. On the other hand, if the display area corresponding to the backlight has pixels in which a small amount of white component is given to the W subpixel (that is, if the chroma is high), the backlight power consumption is reduced only by a small amount. Furthermore, if the luminance is high, the effect may even reversed: the power consumption may greater than the display method of Patent Document 1.

An example is presented below as to how the backlight value is set for two pixels with the same luminance and different chroma.

First, for pixel A having (R, G, B)=(176, 240, 112) (luminance=208, chroma=0.533), the backlight value is calculated as follows.

The amount of light given to the W subpixel in pixel A is (112). The amounts of light for the R, G, B subpixels, after subtraction of the amount of light given to the W subpixel, are (64, 128, 0). As a result, the backlight value setting for pixel A is (128).

Meanwhile, for pixel B having (R, G, B)=(160, 256, 64) (luminance=208, chroma=0.75), the backlight value is calculated as follows.

The amount of light given to the W subpixel in pixel B is (64). The amounts of light for the R, G, B subpixels, after subtraction of the amount of light given to the W subpixel, are (96, 192, 0). As a result, the backlight value setting for pixel B is (192).

Comparing pixels A and B, the two pixels have the same luminance, but pixel B with higher chroma has a higher backlight value setting, thereby achieving a smaller reduction in the backlight power consumption.

The output signal generating section 13 is indeed capable of calculating, by the same processing, the backlight value and subpixel transmittances from the original image data which is fed to the present liquid crystal display device in the first place (i.e., the first input RGB signals). However, in that case, power consumption may not reduced for the entire image for the above reason (in practice, power consumption is frequently reduced for a display at the ordinary, most common intermediate levels).

For these reasons, the present liquid crystal display device includes, before the output signal generating section 13, the luminance lowering section 12 where the first input RGB signals are transformed to luminance-lowered RGB signals by luminance lowering processing. Accordingly, the processing carried out by the output signal generating section 13 is more effective, the backlight power consumption is more reliably reduced by greater amounts.

The following will describe in detail the luminance lowering processing in the liquid crystal display device of the present invention based on embodiment 1.

Embodiment 1

Figure 6:
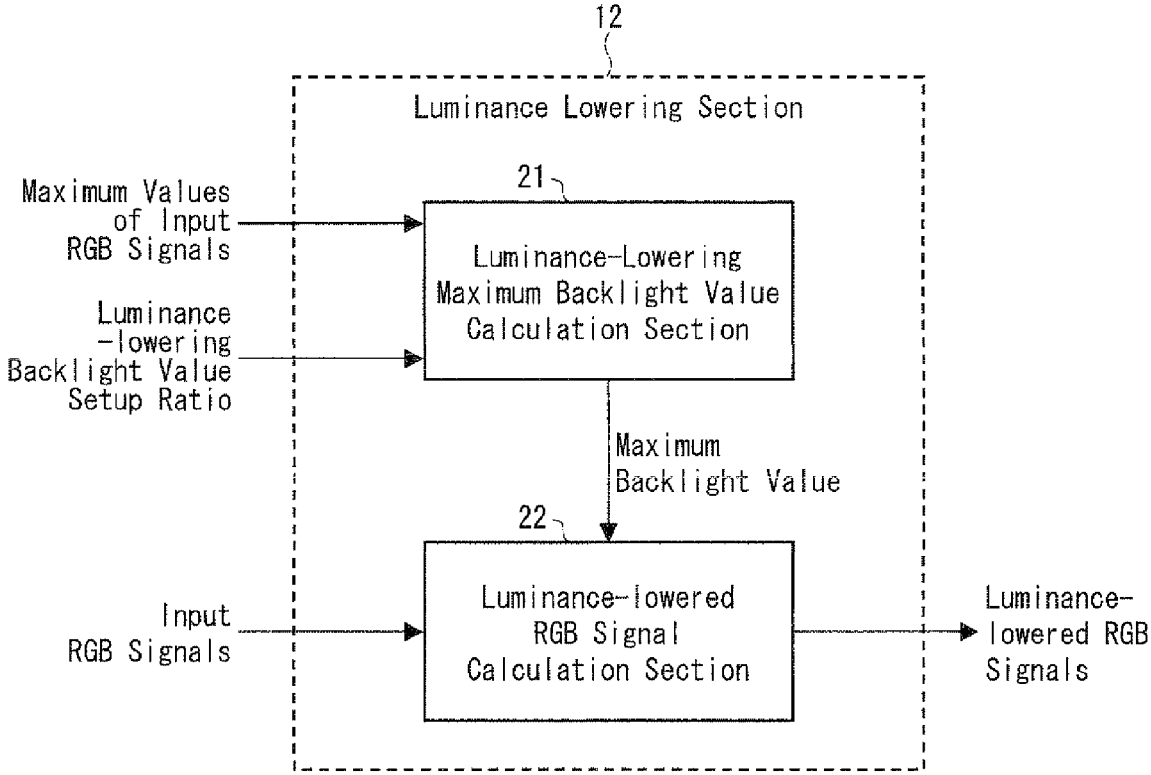
FIG. 6 is a block diagram of a configuration example of a luminance lowering section of embodiment 1 in the liquid crystal display device.
Figure 7:
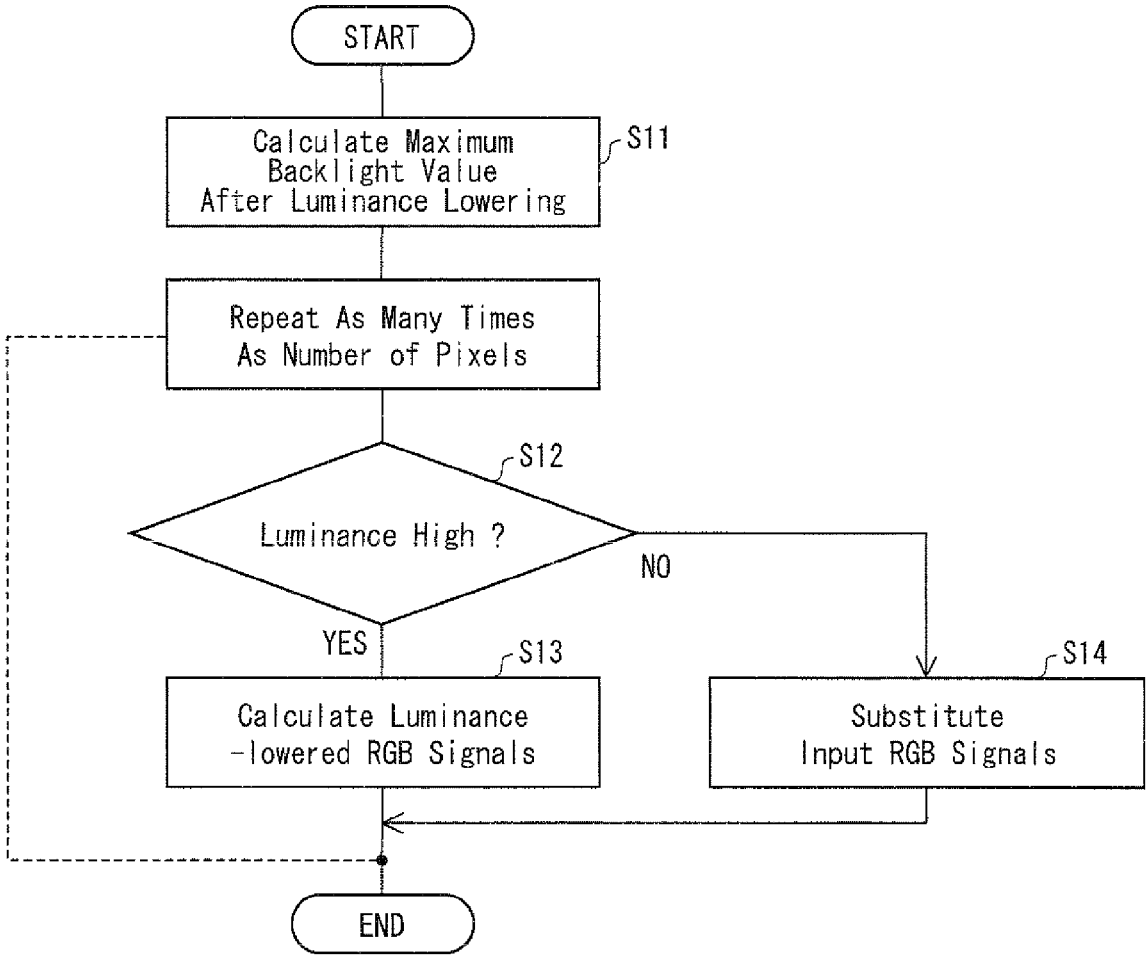
FIG. 7 is a flow chart illustrating an operation of the luminance lowering section shown in FIG. 6.

FIG. 6 illustrates the configuration of the luminance lowering section 12 in a liquid crystal display device of present embodiment 1. The luminance lowering section 12 includes a luminance-lowering maximum backlight value calculation section 21 and a luminance-lowered RGB signal calculation section 22. FIG. 7 is a flow chart of the operation of the luminance lowering section 12.

First, the luminance-lowering maximum backlight value calculation section 21 calculates a maximum backlight value MAXwy by equation (1) below (S11). Equation (1) will be derived later.

$$MAXwy=MAX\times B1Ratioy \quad (1)$$

where MAX is a maximum value of the input RGB signals (i.e., the maximum one of the backlight values when neither chroma lowering nor luminance lowering is preformed) and B1Ratioy is a luminance-lowering backlight value setup ratio ($0\leqq B1Ratioy\leqq 1$).

The luminance lowering section 12 carries out the luminance lowering processing on high luminance pixels. In other words, no luminance lowering processing is preformed on low luminance pixels. The maximum backlight value is used to determine which pixels should be subjected to the luminance lowering processing.

Next, the steps S12 to S14 are repeated as many times as the number of pixels for the input RGB signals.

In S12, the luminance-lowered RGB signal calculation section 22 determines by inequality (2) below whether or not the pixel under consideration (object being subjected to the processing) has a high luminance. Inequality (2) will be derived later.

$$MAXwy<\max(\max RGB/2, \max RGB-\min RGB) \quad (2)$$

where maxRGB=max(R[i], G[i], B[i]), minRGB=min(R[i], G[i], B[i]), max(A, B, . . . ) is the maximum value of A, B, . . . , and min (A, B, . . . ) is the minimum value of A, B, . . . .

The pixels under consideration which satisfy inequality (2) are regarded as having a high luminance.

The luminance-lowered RGB signal calculation section 22 calculates luminance-lowered RGB signals for those pixels by equations (3) to (6) (S13). βy defined by equation (6) is a luminance transform rate.

$$Ry[i]=\beta y\times R[i] \quad (3)$$

$$Gy[i]=\beta y\times G[i] \quad (4)$$

$$By[i]=\beta y\times B[i] \quad (5)$$

$$\beta y=MAXwy/\max(\max RGB/2, \max RGB-\min RGB) \quad (6)$$

The pixels under consideration which fail to satisfy inequality (2) are regarded as having a low luminance. The luminance-lowered RGB signal calculation section 22 does not perform the luminance lowering processing, but transforms the luminance-lowered RGB signals to the same levels as the input RGB signals by equations (7) to (9) below (S14).

$$Ry[i]=R[i] \quad (7)$$

$$Gy[i]=G[i] \quad (8)$$

$$By[i]=B[i] \quad (9)$$

Now, it will be described how equations (1) and (3) to (6) and inequality (2) are derived.

First, if the luminance lowering processing is not performed on the image data (input RGB signals), the maximum backlight value MAXwy is a maximum and equal to MAX when there is a pixel such that maxRGB=MAX and minRGB=0. If the luminance lowering processing is performed to reduce the luminance to 0, the maximum backlight value MAXwy equals 0. Therefore, the range of the maximum backlight value MAXwy is expressed as:

$$0\leqq MAXwy\leqq MAX$$

Here, specifying a backlight value setup ratio B1Ratioy with a range $0\leqq B1Ratioy\leqq 1$ yields equation (1). MAX refers to a maximum value of the input RGB signals. The maximum value is not unique, but could be one of multiple values. Therefore, the minimum value of MAX equals the maximum value (MAXi) of all the RGB values of the input RGB signals. This is because if MAX is smaller than MAXi, the desired backlight value may not be obtained. Meanwhile, the maximum value of MAX equals the maximum value (MAXs) of all the possible values of the input RGB signals. This is because no backlight value greater than MAXs is needed. Supposing that a bit width Bw for the input RGB signals, MAXs is given by $$MAXs=2^{Bw}-1$$

When Bw=8, for example, MAXs equals $2^8-1=255$. Therefore, the effective range of MAX is $$MAXi\leqq MAX\leqq MAXs$$

MAX may be basically set to any value provided that $MAXi\leqq MAX\leqq MAXs$. If MAX=MAXi, the backlight value is reduced by the greatest amount. MAX however needs to calculated for each image. In contrast, when MAX=MAXs, the maximum backlight value (MAXwy) is higher than when MAX=MAXi. However, MAX does not need to be recalculated for each image since MAX assumes a constant value that is not image specific.

B1Ratioy in equation (1) is a constant indicating how far the luminance lowering processing is implemented. In other words, when B1Ratioy equals 1, it indicates that no luminance lowering processing is performed. When B1Ratioy equals 0, it indicates that the processing reduces luminance to a minimum. In the luminance lowering processing, the more the luminance is lowered, the more the backlight power consumption is reduced. However, low luminance means low image quality. Hence, considering a balance between reductions in power consumption and degradation of image quality, B1Ratioy should be set to a proper value from 0 to 1 in accordance with how much luminance needs to be lowered.

Next, inequality (2) will be discussed which represents a threshold as to whether or not to perform the luminance lowering processing.

First, the algorithm as far as the calculation of the backlight value when luminance is not lowered is explained.

The transmission amount Wt[i] by a W subpixel for input RGB signals (R[i], G[i], B[i]) is given by equation (101) below:

$$Wt[i]=\min(\max RGB/2,\min RGB) \tag{101}$$

The transmission amount (Rt[i], Gt[i], Bt[i]) by RGB subpixels for the input RGB signals and the transmission amount Wt[i] by the W subpixel is given by equations (102) to (104) below:

$$Rt[i]=R[i]-Wt[i] \tag{102}$$

$$Gt[i]=G[i]-Wt[i] \tag{103}$$

$$Bt[i]=B[i]-Wt[i] \tag{104}$$

The backlight value Wb under these conditions is given by equation (105) below:

$$Wb=\max(Rt[1],Gt[1],Bt[1],Wt[1],\ldots,$$

$$\mathrm{Rt[Np],Gt[Np],Bt[Np],Wt[Np]}) \tag{105}$$

Equations (101) to (104) show that not all RGBW transmission amounts drop to below 0.

Next, the condition under which the W transmission amount does not exceed the maximum backlight value MAXwy is $$\mathrm{Wt[i]} \leqq \mathrm{MAXwy}$$

Therefore, $$\min(\max RGB/2,\min RGB) \leqq \mathrm{MAX}wy \tag{106}$$

The conditions under which the RGB transmission amounts do not exceed the maximum backlight value MAXwy are $$\mathrm{Rt[i]} \leqq \mathrm{MAXwy} \tag{107}$$

$$\mathrm{Gt[i]} \leqq \mathrm{MAXwy} \tag{108}$$

$$\mathrm{Bt[i]} \leqq \mathrm{MAXwy} \tag{109}$$

From equations (101) to (104) and inequalities (107) to (109), the condition under which none of the RGB transmission amounts exceeds MAXwy is $$\max(Rt[i],Gt[i],Bt[i]) \leqq \mathrm{MAX}wy$$

$$\max RGB-Wt[i] \leqq \mathrm{MAX}wy$$

Therefore, $$\max RGB-\min(\max RGB/2,\min RGB) \leqq \mathrm{MAX}wy \tag{110}$$

Here, when maxRGB/2≦minRGB, the condition under which the W transmission amount does not exceed MAXwy is derived from inequality (106):

$$\max RGB/2 \leqq \mathrm{MAX}wy \tag{111}$$

Likewise, when maxRGB/2≦minRGB, the condition under which the RGB transmission amounts do not exceed MAXwy is derived from inequality (110):

$$\max RGB-\max RGB/2 \leqq \mathrm{MAX}wy$$

Therefore, $$\max RGB/2 \leqq \mathrm{MAX}wy$$

This inequality is the same as inequality (111).

Therefore, when maxRGB/2≦minRGB, the condition under which none of the RGBW transmission amounts exceeds MAXwy is represented by inequality (111).

Meanwhile, when minRGB<maxRGB/2, the condition under which the W transmission amount does not exceed MAXwy is derived from inequality (106):

$$\mathrm{minRGB} \leqq \mathrm{MAXwy} \tag{112}$$

Likewise, when minRGB<maxRGB/2, the condition under which the RGB transmission amounts do not exceed MAXwy is derived from inequality (110):

$$\max RGB-\min RGB \leqq \mathrm{MAX}wy \tag{113}$$

Therefore, when minRGB<maxRGB/2, the condition under which none of the RGBW transmission amounts exceeds MAXwy is derived by combining inequality (112) and inequality (113):

$$\max(\min RGB,\max RGB-\min RGB) \leqq \mathrm{MAX}wy \tag{114}$$

Since minRGB<maxRGB/2=maxRGB−maxRGB/2<maxRGB−minRGB, inequality (114) can be rearranged as $$\max RGB-\min RGB \leqq \mathrm{MAX}wy \tag{115}$$

In contrast, the conditions under which at least one of the RGBW transmission amounts exceeds MAXwy is as follows.

First, when maxRGB/2≦minRGB, the relationship in inequality (111) is reversed:

$$\mathrm{MAXwy} < \mathrm{maxRGB/2} \tag{116}$$

When minRGB<maxRGB/2, the relationship in inequality (115) is reversed:

$$\mathrm{MAX}wy < \max RGB-\min RGB \tag{117}$$

Inequalities (116), (117) will be further rearranged.

First, inequality (116) represents a condition under which at least one of the RGBW transmission amounts exceeds MAXwy when maxRGB/2≦minRGB. By rearranging the inequality, maxRGB/2≦minRGB, the following inequalities are obtained:

$$\max RGB/2 \leqq \min RGB$$

$$\max RGB-\max RGB/2 \leqq \min RGB$$

Therefore, $$\max RGB-\min RGB \leqq \max RGB/2 \tag{118}$$

When inequality (118) is satisfied, rearranging inequality (116) yields inequality (2).

Inequality (117) represents a condition under which at least one of the RGBW transmission amounts exceeds MAXwy when minRGB<maxRGB/2. By rearranging the inequality, minRGB<maxRGB/2, the following inequalities are obtained:

$$\min RGB < \max RGB/2$$

$$\min RGB < \max RGB - \max RGB/2$$

$$\max RGB/2 < \max RGB - \min RGB \quad (119)$$

When inequality (119) is satisfied, rearranging inequality (117) again yields inequality (2).

In other words, from inequalities (118), (119), the condition under which at least one of the RGBW transmission amounts exceeds MAXwy is reduced simply to inequality (2). This means that when R[i], G[i], B[i] satisfy inequality (2), it indicates that at least one of the RGBW transmission amounts exceeds MAXwy. Therefore, the backlight value is made not to exceed MAXwy by performing the luminance lowering processing.

Next will be described how equations (3) to (6) used for luminance lowering calculation are derived.

Equations (3) to (5) are transform equations for lowering only luminance while maintaining chroma and hue unchanged before and after the transform. Note that the luminance transform rate βy satisfies $0 \leqq \beta y < 1$. The following will prove that equations (3) to (5) maintain chroma and hue unchanged throughout the luminance lowering processing.

First, the chroma S[i] before the luminance lowering processing is given by the equation:

$$S[i] = 1 - \min RGB / \max RGB$$

From equations (3) to (5), the chroma Sy[i] after the luminance lowering processing is given by the equation:

$$\begin{aligned} Sy[i] &= 1 - \min RGBy / \max RGBy \quad (120) \\ &= 1 - (\beta y \times \min RGB) / (\beta y \times \max RGB) \\ &= 1 - \min RGB / \max RGB \\ &= S[i] \end{aligned}$$

where $$\max RGBy = \max(Ry[i], Gy[i], By[i])$$

$$\min RGBy = \min(Ry[i], Gy[i], By[i])$$

Equation (120) shows that the chroma remains unchanged throughout the luminance lowering processing.

In contrast, consider hue when the R value is a maximum. First, when the R value is a maximum, the hue H[i] before the luminance lowering processing is given by the equation:

$$H[i] = (Cb - Cg) \times 60$$

where $$Cb = (\max RGB - B[i]) / (\max RGB - \min RGB)$$

$$Cg = (\max RGB - G[i]) / (\max RGB - \min RGB)$$

Next, from equations (3) to (5), the hue Hy[i] after the luminance lowering processing is given by the equation:

$$Hy[i] = (Cby - Cgy) \times 60 \quad (121)$$

where $$Cby = (\max RGBy - By[i]) / (\max RGBy - \min RGBy)$$

$$Cgy = (\max RGBy - Gy[i]) / (\max RGBy - \min RGBy)$$

Rearranging equation (121) and substituting equations (3) to (5) yields the following equation:

$$\begin{aligned} Hy[i] &= [\{(\max RGBy - By[i]) - (\max RGBy - Gy[i])\} / (\max RGBy - \min RGBy)] \times 60 \quad (122) \\ &= \{(Gy[i] - By[i]) / (\max RGBy - \min RGBy)\} \times 60 \\ &= [\beta y \times (G[i] - B[i]) / \{By \times (\max RGB - \min RGB)\}] \times 60 \\ &= \{(G[i] - B[i]) / (\max RGB - \min RGB)\} \times 60 \\ &= [\{(\max RGB - B[i]) - (\max RGB - G[i])\} / (\max RGB - \min RGB)] \times 60 \\ &= (Cb - Cg) \times 60 \\ &= H[i] \end{aligned}$$

Equation (122) shows that hue also remains unchanged throughout the luminance lowering by equations (3) to (5). The same description applies when the G value or the B value is a maximum.

Next, an expression for the luminance transform rate βy is derived such that the backlight value equals MAXwy when luminance lowering equations are given as equations (3) to (5).

By lowering luminance of all pixels satisfying inequality (2) so as to satisfy equation (123), the backlight value is always less than or equal to MAXwy.

$$\max wy = \max(\max RGBy/2, \max RGBy - \min RGBy) \quad (123)$$

From equations (3) to (5) and (123), $$\max wy = \beta y \times \max(\max RGB/2, \max RGB - \min RGB)$$

Therefore, $$\beta y = \max wy / \max(\max RGB/2, \max RGB - \min RGB)$$

Equation (6) is thus derived. Also, from the relationship in inequality (2), equation (6) satisfies $0 \leqq \beta y < 1$ (luminance is lowered).

As detailed above, the luminance lowering section 12 transforms the input RGB signals to the luminance-lowered RGB signals for output to the subsequent output signal generating section 13 by the processing described above. In other words, the luminance-lowered RGB signals are results of transform of high luminance pixel data represented by the input RGB signals to low luminance pixel data. The low luminance pixel data represented by the input RGB signals is not transformed; the same, non-transformed data is represented by the luminance-lowered RGB signals.

Figure 8:
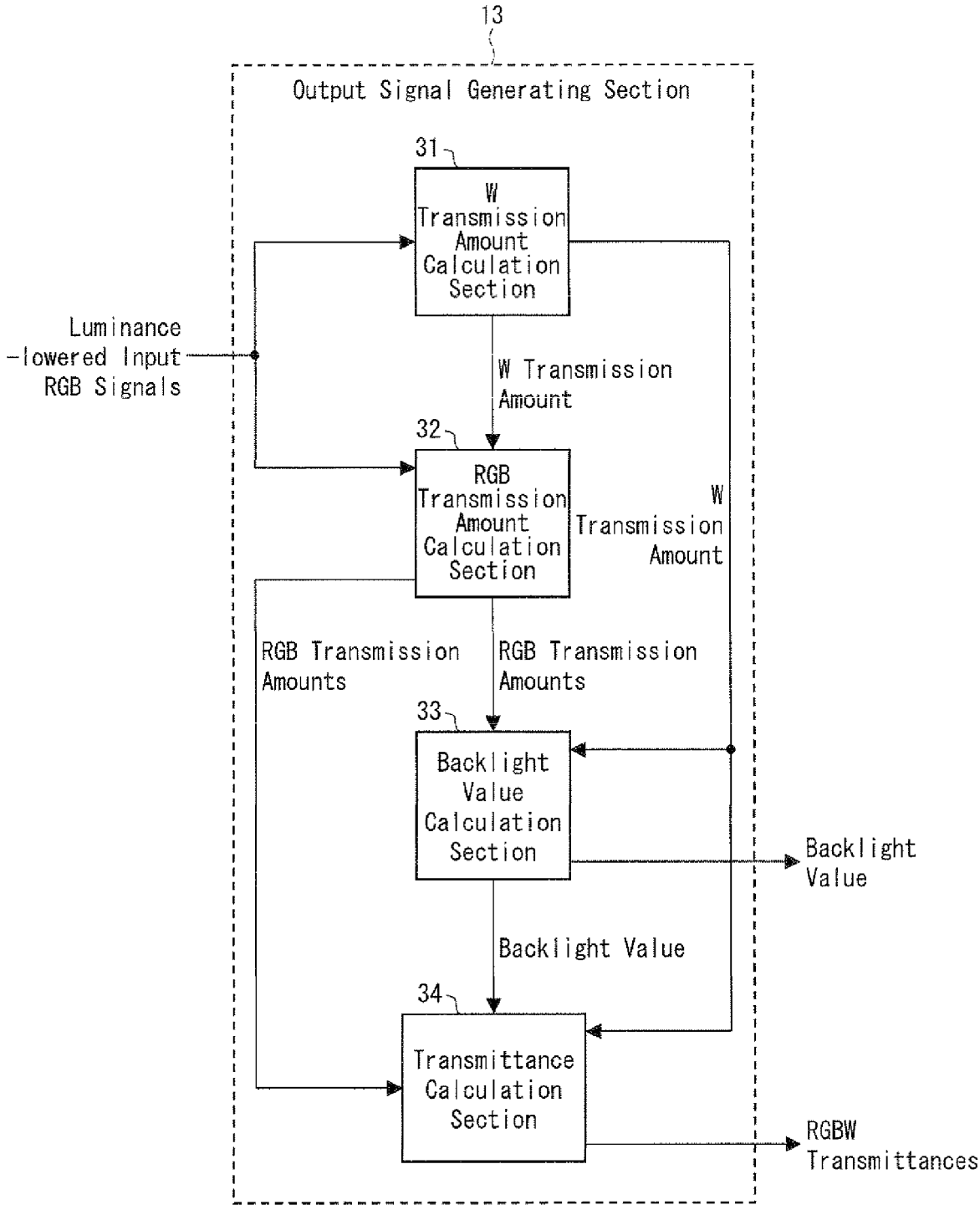
FIG. 8 is a block diagram of a configuration example of an output signal generating section in the liquid crystal display device.
Figure 9:
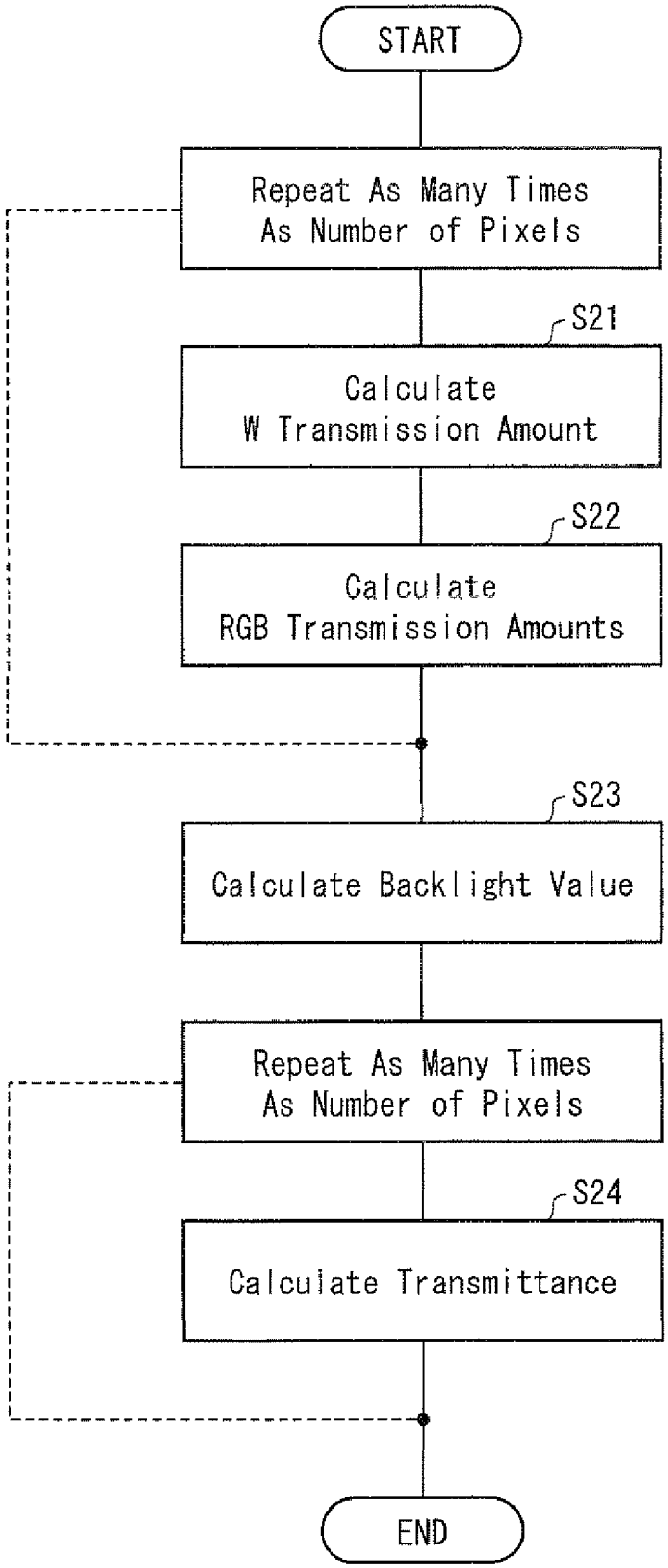
FIG. 9 is a flow chart illustrating an operation of the output signal generating section shown in FIG. 8.

Next will be described schematically the configuration of the output signal generating section 13 in reference to FIG. 8. The output signal generating section 13, as illustrated in FIG. 8, includes a W transmission amount calculation section 31, an RGB transmission amount calculation section 32, a backlight value calculation section 33, and a transmittance calculation section 34. FIG. 9 is a flow chart illustrating the operation of the output signal generating section 13.

First, the W transmission amount calculation section 31 calculates the W transmission amount Wty[i] for the pixel under consideration from the luminance-lowered RGB signals by equation (28) (S21).

$$Wty[i] = \min(\max RGBy/2, \min RGBy) \quad (28)$$

Next, the RGB transmission amount calculation section 32 calculates the RGB transmission amounts (Rty[i], Gty[i], Bty[i]) from the luminance-lowered RGB signals and the W transmission amount for the pixel under consideration by equations (29) to (31) (S22).

$$Rty[i]=Ry[i]-Wty[i] \quad (29)$$

$$Gty[i]=Gy[i]-Wty[i] \quad (30)$$

$$Bty[i]=By[i]-Wty[i] \quad (31)$$

The steps S21 to S22 are repeated as many times as the number of pixels for the input RGB signals.

The backlight value calculation section 33 calculates the backlight value Wby from the RGBW transmission amounts of all the pixels by equation (32) (S23).

$$Wby=\max(Rty[1],Gty[1],Bty[1],Wty[1],\ldots,Rty[Np],Gty[Np],Bty[Np],Wty[Np]) \quad (32)$$

Next, the transmittance calculation section 34 calculates the RGBW transmittances for the pixel under consideration from the RGBW transmission amounts and the backlight value by equations (33) to (36) (S24). The step S24 is repeated as many times as the number of pixels for the input RGB signals.

$$ry[i]=Rty[i]/Wby \quad (33)$$

$$gy[i]=Gty[i]/Wby \quad (34)$$

$$by[i]=Bty[i]/Wby \quad (35)$$

$$wy[i]=Wty[i]/Wby \quad (36)$$

Note that when Wby=0, ry[i]=gy[i]=by[i]=wy[i]=0.

As detailed above, in the liquid crystal display device of present embodiment 1, the luminance lowering processing is implemented on the input RGB signals (original inputs) before the output signal generating section 13 calculates the backlight value and the RGBW transmittances. This arrangement reliably lowers the backlight value.

Taking pixel B having (R, G, B)=(160, 256, 64) as an example, the backlight value equals 192 if no luminance lowering processing is performed.

In contrast, if same pixel B is subjected to the luminance lowering processing where MAX=256 and B1Ratioy=0.5, the pixel value of pixel B after the luminance lowering processing on the luminance-lowered RGB signals is obtained as follows.

First, the maximum backlight value MAXwy is calculated by equation (1):

$$MAXwy=MAX\times B1Ratioy=256\times 0.5=128$$

Next, the luminance-lowered RGB signals (Ry[1], Gy[1], By[1]) are calculated by equations (3) to (6):

$$\beta y=MAXwy/\max(\max RGB/2,\max RGB-\min RGB)=128/\max(256/2,256-64)=2/3$$

$$Ry[1]=\beta y\times R[1]=(2/3)\times 160=107$$

$$Gy[1]=\beta y\times G[1]=(2/3)\times 256=171$$

$$By[1]=\beta y\times B[1]=(2/3)\times 64=43$$

The backlight value is calculated as follows.

First, the W transmission amount Wty[1] is calculated by equation (28):

$$Wty[1]=\min(\max RGBy/2,\ \min RGBy)=\min(171/2,43)=43$$

The RGB transmission amounts (Rty[1], Gty[1], Bty[1]) are calculated by equations (29) to (31):

$$Rty[1]=Ry[1]-Wty[1]=107-43=64$$

$$Gty[1]=Gy[1]-Wty[1]=171-43=128$$

$$Bty[1]=By[1]-Wty[1]=43-43=0$$

Finally, the backlight value Wby is calculated by equation (32):

$$Wby=\max(Rty[1],Gty[1],Bty[1],Wty[1])=\max(64,128,0,43)=128$$

Hence, the luminance lowering processing reduces the backlight value from 192 to 128 (a reduction by about 33%).

Embodiment 2

Embodiment 1 above lowered the backlight value by lowering only luminance. Present embodiment 2 lowers the backlight value by lowering both chroma and luminance.

Lowering only luminance by very large amounts as in embodiment 1 makes degradation of image quality easy to recognize. Lowering both luminance and chroma by moderate amounts lowers the backlight value similarly to lowering only luminance, while not making degradation of image quality as easy to recognize. The same members as in embodiment 1 are given the same reference numerals as in embodiment 1, and their detailed description is not repeated here.

Figure 10:
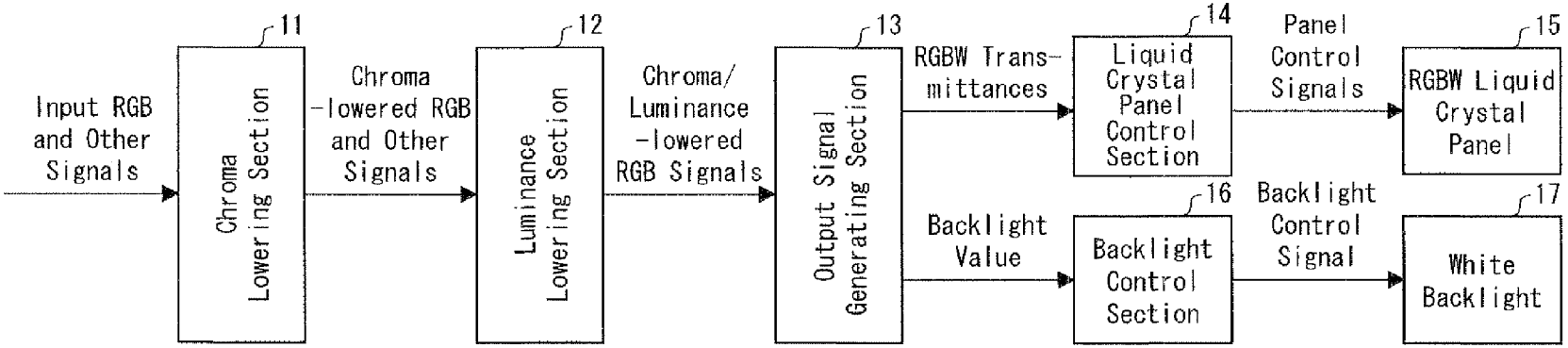
FIG. 10, relating to another embodiment of the present invention, is a block diagram of the configuration of a major part of liquid crystal display device of embodiment 2.

The liquid crystal display device of present embodiment 2, as illustrated in FIG. 10, includes a chroma lowering section 11, a luminance lowering section 12, an output signal generating section 13, a liquid crystal panel control section 14, an RGBW liquid crystal panel ("liquid crystal panel") 15, a backlight control section 16, and a white backlight ("backlight") 17. The chroma lowering section 11 calculates chroma-lowered RGB signals from input RGB and other signals for output to the subsequent luminance lowering section 12.

Figure 11:
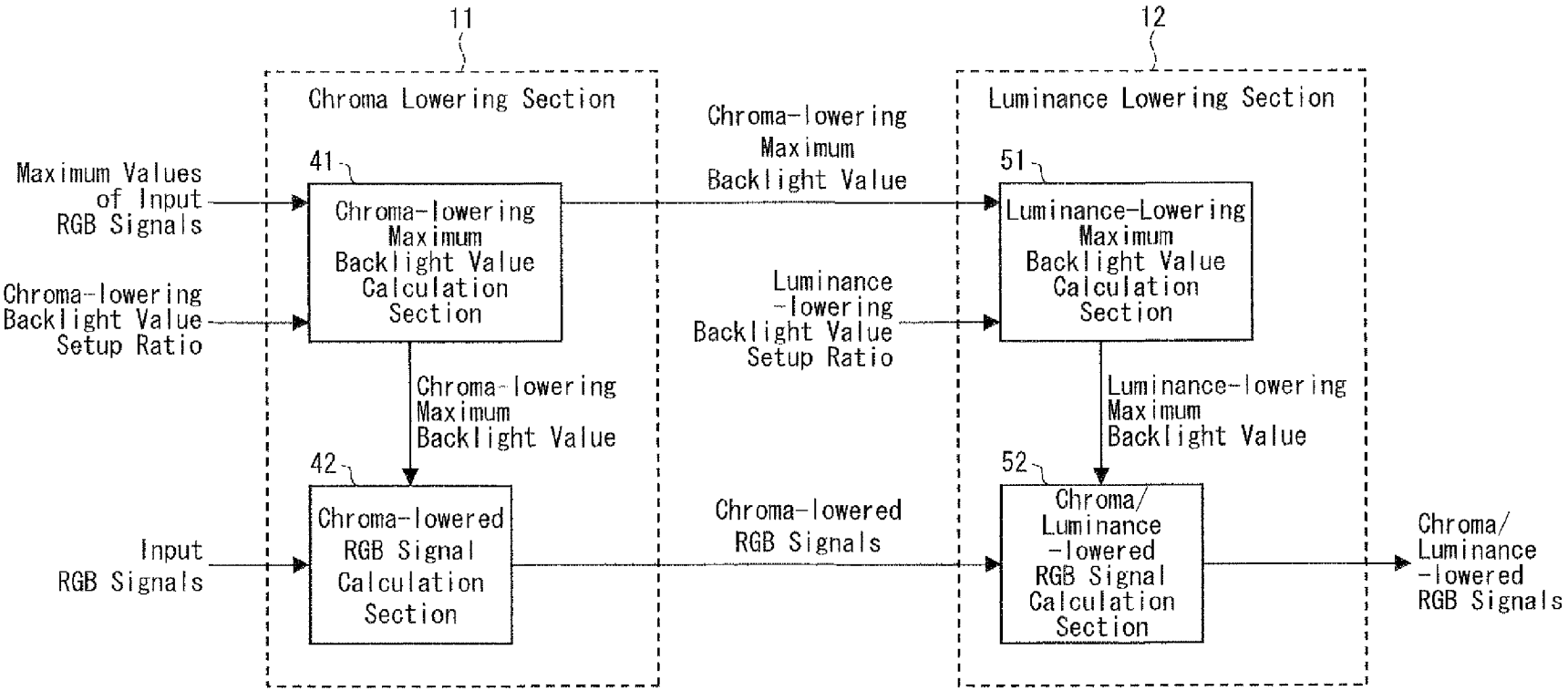
FIG. 11 is a block diagram of a configuration example of a chroma lowering section and a luminance lowering section in the liquid crystal display device of embodiment 2.

FIG. 11 illustrates the configuration of the chroma lowering section 11 and the luminance lowering section 12 in the liquid crystal display device of present embodiment 2. The chroma lowering section 11 includes a chroma-lowering maximum backlight value calculation section 41 and a chroma-lowered RGB signal calculation section 42. The luminance lowering section 12 includes a luminance-lowering maximum backlight value calculation section 51 and a chroma/luminance-lowered RGB signal calculation section 52.

The chroma-lowering maximum backlight value calculation section 41 calculates a chroma-lowering maximum backlight value from a maximum value of the input RGB signals and a chroma-lowering backlight value setup ratio for output to the chroma-lowered RGB signal calculation section 42 and the luminance-lowering maximum backlight value calculation section 51. The chroma-lowered RGB signal calculation section 42 calculates chroma-lowered RGB signals from the input RGB signals and the chroma-lowering maximum backlight value for output to the chroma/luminance-lowered RGB signal calculation section 52.

The luminance-lowering maximum backlight value calculation section 51 calculates a luminance-lowering maximum backlight value from the chroma-lowering maximum backlight value and a luminance-lowering backlight value setup ratio for output to the chroma/luminance-lowered RGB signal calculation section 52. The chroma/luminance-lowered RGB signal calculation section 52 calculates chroma/luminance-lowered RGB signals from the chroma-lowered RGB signals and the luminance-lowering maximum backlight value for output to the output signal generating section 13.

Figure 12:
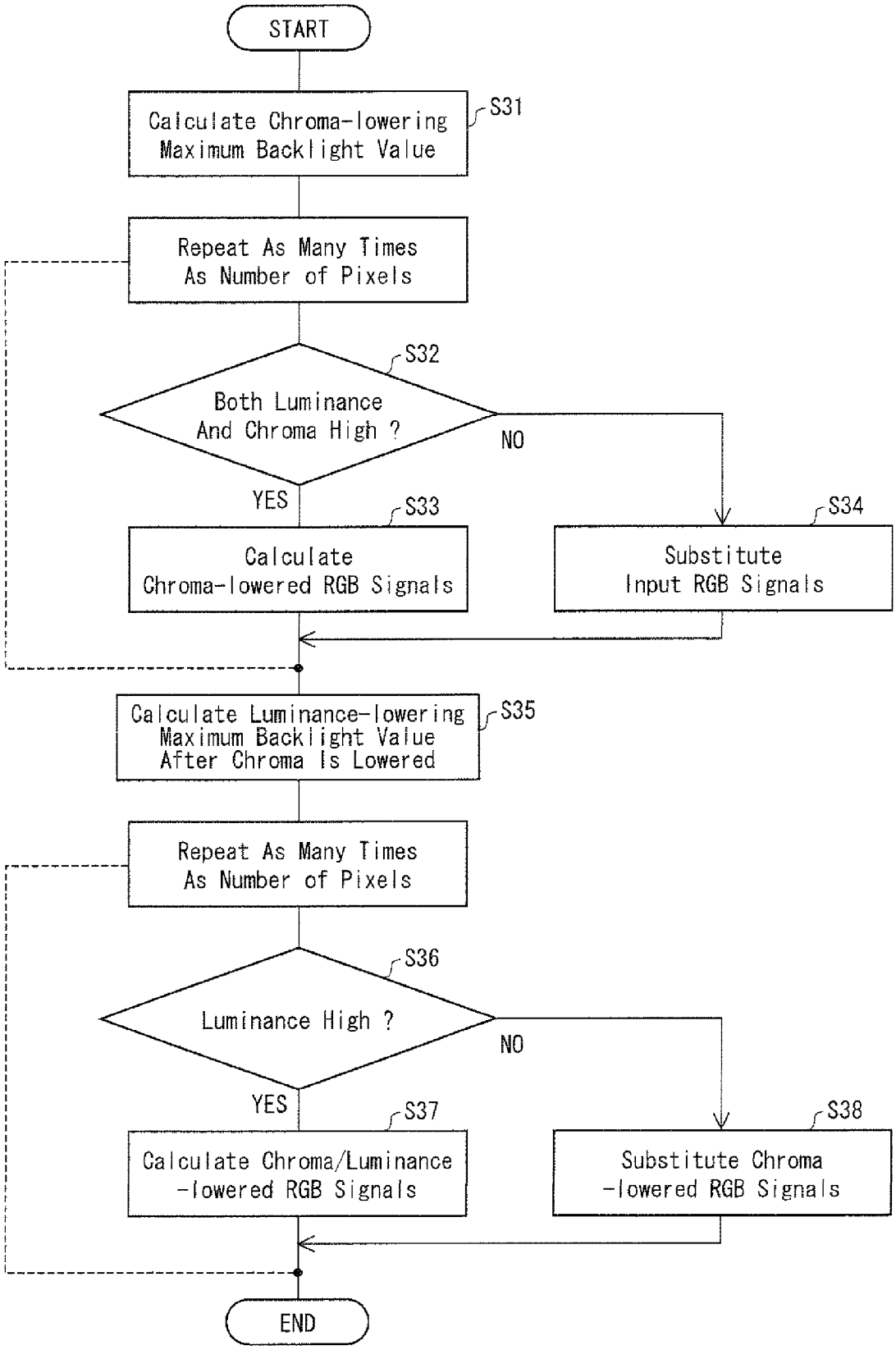
FIG. 12 is a flow chart illustrating an operation of the chroma lowering section and the luminance lowering section shown in FIG. 11.

FIG. 12 is a flow chart the operation of the chroma lowering section 11 and another operation of the luminance lowering section 12.

First, the chroma-lowering maximum backlight value calculation section 41 calculates a chroma-lowering maximum backlight value MAXws by equation (10) below (S31):

$$MAXws = MAX \times B1Ratios \quad (10)$$

where B1Ratios is a chroma-lowering backlight value setup ratio ($0.5 \leqq B1Ratios \leqq 1.0$).

Next, the steps S32 to S34 are repeated as many times as the number of pixels for the input RGB signals.

First, the chroma-lowered RGB signal calculation section 42 determines whether or not the luminance and chroma for a pixel under consideration (object being subjected to the processing) are both high by inequality (11) below (S32):

$$MAXws < maxRGB - minRGB \quad (11)$$

The pixels under consideration which satisfy inequality (11) are regarded as having both a high luminance and a high chroma. The chroma-lowered RGB signal calculation section 42 calculates chroma-lowered RGB signals for those pixels by equations (12) to (15) (S33). $\alpha s$ defined by equation (15) is a chroma transform ratio.

$$Rs[i] = \alpha s \times R[i] + (1 - \alpha s) \times Y[i] \quad (12)$$

$$Gs[i] = \alpha s \times G[i] + (1 - \alpha s) \times Y[i] \quad (13)$$

$$Bs[i] = \alpha s = B[i] + (1 - \alpha s) \times Y[i] \quad (14)$$

$$\alpha s = MAXws/(maxRGB - minRGB) \quad (15)$$

where Y[i] is the luminance of the input RGB signals (R[i], G[i], B[i]) (for example, $Y[i] = (2 \times R[i] + 5 \times G[i] + B[i])/8$). In contrast, the pixels under consideration which fail to satisfy inequality (11) are regarded as having either a low luminance or a low chroma or both a low luminance and a low chroma. The chroma-lowered RGB signal calculation section 42 does not perform the chroma lowering processing, but transforms the chroma-lowered RGB signals to the same levels as the input RGB signals by equations (16) to (18) below (S34).

$$Rs[i] = R[i] \quad (16)$$

$$Gs[i] = G[i] \quad (17)$$

$$Bs[i] = B[i] \quad (18)$$

Next, the luminance-lowering maximum backlight value calculation section 51 calculates a luminance-lowering maximum backlight value MAXwsy by equation (19) (S35).

$$MAXwsy = MAXws \times B1Ratioy \quad (19)$$

In embodiment 1, the luminance-lowering maximum backlight value MAXwy was calculated by multiplying a maximum value MAX of the input RGB signals (i.e., the maximum one of the backlight values when neither chroma lowering nor luminance lowering is preformed) by the luminance-lowering backlight value setup ratio B1Ratioy. Meanwhile, in present embodiment 2, the chroma lowering implemented before the luminance lowering makes the backlight values less than or equal to the chroma-lowering maximum backlight value MAXws. In other words, since the maximum one of backlight values equals MAXws at this point, the luminance-lowering maximum backlight value MAXwsy is calculated by multiplying MAXws by B1Ratioy.

Accordingly, the luminance lowering processing following the chroma lowering processing further reduces the backlight values and ensures that the backlight values will at the end be less than or equal to MAXwsy.

Next, the steps S36 to S38 are repeated as many times as the number of pixels for the input RGB signals.

Next, the chroma/luminance-lowered RGB signal calculation section 52 determines whether or not the luminance for a pixel under consideration (object being subjected to the processing) is high by inequality (20) (S36).

$$MAXwsy < max(maxRGBs/2, maxRGBs - minRGBs) \quad (20)$$

The pixels under consideration which satisfy inequality (20) are regarded as having a high luminance. The chroma/luminance-lowered RGB signal calculation section 52 calculates chroma/luminance-lowered RGB signals by equations (21) to (24) (S37). $\beta sy$ defined by equation (24) is a luminance transform rate when the chroma-lowered RGB signals are subjected to luminance lowering.

$$Rsy[i] = \beta sy \times Rs[i] \quad (21)$$

$$Gsy[i] = \beta sy \times Gs[i] \quad (22)$$

$$Bsy[i] = \beta sy \times Bs[i] \quad (23)$$

$$\beta sy = MAXwsy/max(maxRGBs/2, maxRGBs - minRGBs) \quad (24)$$

where $$maxRGBs = max(Rs[i], Gs[i], Bs[i])$$

$$minRGBs = min(Rs[i], Gs[i], Bs[i])$$

Meanwhile, the pixels under consideration which fail to satisfy inequality (20) are regarded as having a low luminance. The chroma/luminance-lowered RGB signal calculation section 52 does not perform the luminance lowering processing, but transforms the chroma/luminance-lowered RGB signals to the same levels as the chroma-lowered RGB signals by equations (25) to (27) below (S38).

$$Rsy[i] = Rs[i] \quad (25)$$

$$Gsy[i] = Gs[i] \quad (26)$$

$$Bsy[i] = Bs[i] \quad (27)$$

Now, it will be described how chroma lowering equations for the steps are derived. Assume in the following description that the backlight value is lowered to or below a desired value by lowering the chroma of the input RGB signals.

If no chroma lowering processing is performed, the backlight value is the largest when the chroma equals 1 (no amount of light can be given to the W subpixels) and at least one of the RGB values equals MAX. Under these conditions, the backlight value equals MAX.

In contrast, if the backlight value is lowered as much as possible by the chroma lowering processing, the backlight value is the largest when the chroma equals 0 (the chroma cannot be lowered any further; the backlight value cannot be lowered) and all the RGB values equal MAX. Under these conditions, the backlight value equals MAX/2.

Therefore, MAXws has a ranges given in inequality (124). When B1Ratios ranges from 0.5 to 1.0, MAXws is given by equation (10).

$$MAX/2 \leqq MAXws \leqq MAX \quad (124)$$

Next will be described how inequality (11) is derived which gives conditions to determine whether or not to perform the chroma lowering processing.

First, the algorithm up to the calculation of the backlight value when no chroma lowering is performed is given by equations (101) to (105) as detailed in embodiment 1.

It can be seen from equations (101) to (104) that not all RGBW transmission amounts drop to below 0.

Next, the W transmission amount does not exceed the maximum backlight value MAXws under the condition:

$$Wt[i] \leqq MAXws$$

Therefore, $$\min(\max RGB/2, \min RGB) \leqq MAXws \quad (125)$$

The RGB transmission amounts do not exceed the maximum backlight value MAXws under the conditions:

$$Rt[i] \leqq MAXws \quad (126)$$

$$Gt[i] \leqq MAXws \quad (127)$$

$$Bt[i] \leqq MAXws \quad (128)$$

From equations (101) to (104) and inequalities (126) to (128), none of the RGB transmission amounts exceeds MAXwy under the conditions:

$$\max(Rt[i], Gt[i], Bt[i]) \leqq MAXws$$

$$\max RGB - Wt[i] \leqq MAXws$$

Therefore, $$\max RGB - \min(\max RGB/2, \min RGB) \leqq MAXws \quad (129)$$

From inequality (125), when maxRGB/2≦minRGB, the W transmission amount does not exceed MAXwy under the condition:

$$\max RGB/2 \leqq MAXws \quad (130)$$

From inequality (124), $$\max RGB/2 \leqq MAX/2 \leqq MAXws$$

Therefore, inequality (130) always holds.

Likewise, when maxRGB/2≦minRGB, from inequality (129), the RGB transmission amounts do not exceed MAXws under the condition:

$$\max RGB - \max RGB/2 \leqq MAXws$$

Therefore, $$\max RGB/2 \leqq MAXws$$

This is the same inequality as inequality (130) and therefore always holds.

Therefore, when maxRGB/2≦minRGB, none of the RGBW transmission amounts exceeds MAXwy under the condition given by inequality (130).

In contrast, from inequality (125), when minRGB<maxRGB/2, the W transmission amount does not exceed MAXws under the condition:

$$\min RGB \leqq MAXws \quad (131)$$

Since minRGB<maxRGB/2 here, from inequality (124), $$\min RGB < \max RGB/2 \leqq MAX/2 \leqq MAXws$$

Inequality (131) always holds.

Likewise, from inequality (129), when minRGB<maxRGB/2, the RGB transmission amounts do not exceed MAXws under the condition:

$$\max RGB - \min RGB \leqq MAXws \quad (132)$$

Inequality (132) does not always hold. Therefore, when minRGB<maxRGB/2, none of the RGBW transmission amounts exceeds MAXws under the condition given by inequality (132).

On the other hand, when minRGB<maxRGB/2, at least one of the RGBW transmission amounts exceeds MAXws under the condition given by inequality (11) above. When inequality (11) holds, from inequality (124), $$\max RGB/2 \leqq MAX/2 \leqq MAXws < \max RGB - \min RGB$$

$$\max RGB/2 < \max RGB - \min RGB$$

Therefore, $$\min RGB < \max RGB/2$$

In other words, the initial presumption, minRGB<maxRGB/2, always holds.

Therefore, at least one of the RGBW transmission amounts unconditionally exceeds MAXs under the condition given by inequality (11).

In other words, when R[i], G[i], B[i] satisfy inequality (11), the backlight value is adjusted not to exceed MAXws by performing the chroma lowering processing.

Next will be described how equations (12) to (15) used for chroma lowering calculation are derived.

First, the equations for the transform of the RGB signals (lowering only chroma, with luminance and hue unchanged) are given in equations (12) to (14) when inequality (133) below is satisfied:

$$0 \leqq \alpha s < 1 \quad (133)$$

Here is the proof for the chroma lowering processing of equations (12) to (14) maintaining the luminance and hue of the RGB signals unchanged.

First, supposing that when the RGB values=(R, G, B), the luminance is given by the expression (2×R+5×G+B)/8, the luminance Ys[i] after the chroma lowering is given by equation (134).

$$Ys[i] = (2 \times Rs[i] + 5 \times Gs[i] + Bs[i])/8 \quad (134)$$

Substituting equations (12) to (14) into equation (134), equation (135) is obtained.

$$\begin{aligned} Ys[i] &= \alpha s \times (2 \times R[i] + 5 \times G[i] + B[i])/8 + (1 - \alpha s) \times Y[i] \quad (135) \\ &= \alpha s \times Y[i] + (1 - \alpha s) \times Y[i] \\ &= Y[i] \end{aligned}$$

It is understood from equation (135) that the chroma lowering processing does not change the luminance value.

As for the hue, the case when the R value is a maximum is considered as an example. First, the hue H[i] before the chroma lowering when the R value is a maximum is given by $$H[i] = (Cb - Cg) \times 60$$

where Cb=(maxRGB−B[i])/(maxRGB−minRGB) and Cg=(maxRGB−G[i])/(maxRGB−minRGB).

Next, the hue Hs[i] after the chroma transform is given by equation (136) below:

$$Hs[i] = (Cbs - Cgs) \times 60 \quad (136)$$

where $$Cbs = (\max RGBs - Bs[i])/(\max RGBs - \min RGBs)$$

$$Cgs = (\max RGBs - Gs[i])/(\max RGBs - \min RGBs)$$

Rearranging equation (136) and substituting equations (12) to (14), equation (137) is obtained:

$$Hs[i] = [\{(\max RGBs - Bs[i]) - (\max RGBs - Gs[i])\} / (\max RGBs - \min RGBs)] \times 60$$
$$= \{(Gs[i] - Bs[i]) / (\max RGBs - \min RGBs)\} \times 60$$
$$= [\alpha s \times (G[i] - B[i]) / \{\alpha s \times (\max RGB - \min RGB)\}] \times 60$$

$$=\{(G[i]-B[i])/(\max RGB-\min RGB)\}\times 60$$

$$=[\{(\max RGB-B[i])-(\max RGB-G[i])\}/(\max RGB-\min RGB)]\times 60$$

$$=(Cb-Cg)\times 60$$

$$=H[i] \quad (137)$$

Equation (137) shows that the chroma lowering processing does not change the hue either. The same description applies when the G value or the B value is a maximum.

Next will be derived an equation for as such that the backlight value equals MAXws when the chroma lowering equations are given in equations (12) to (14).

If chroma is lowered so as to satisfy equation (138) below for all the pixels satisfying inequality (11), the backlight value is always less than or equal to MAXws.

$$\mathrm{MAX}ws=\max RGBs-\min RGBs \quad (138)$$

From equations (12) to (14) and (138), the following equation is obtained:

$$\mathrm{MAX}ws=\alpha s\times\max RGB+(1-\alpha s)\times Y[i]$$

$$-\alpha s\times\mathrm{minRGB}-(1-\alpha s)\times Y[i]$$

$$\mathrm{MAX}ws=\alpha s\times\max RGB-+s\times\min RGB$$

$$\mathrm{MAX}ws=\alpha s\times(\max RGB-\min RGB)$$

Therefore, $$\alpha s=\mathrm{MAX}ws/(\max RGB-\min RGB)$$

Equation (15) is derived in this manner. αs calculated by equation (15) satisfies the conditions given in inequality (133) because of the relations given in inequality (11) (chroma is lowered).

The output signal generating section 13 of present embodiment 2 has the same structure as the output signal generating section 13 of embodiment 1. The only difference from embodiment 1 is the input signals.

Specifically, the luminance-lowered RGB signals (Ry[i], Gy[i], By[i]) are supplied to the output signal generating section 13 in embodiment 1. In present embodiment 2, the input signals are the chroma/luminance-lowered RGB signals (Rsy[i], Gsy[i], Bsy[i]).

Therefore, the output signal generating section 13 of present embodiment 2 calculate the backlight value Wbsy and the RGBW transmittances (rsy[i], gsy[i], bsy[i], wsy[i]) by procedures A) to D) below.

A) Calculation of W Transmission Amount (Wtsy[i])

$$Wtsy[i]=\min(\max RGBsy/2,\min RGBsy)$$

where $$\max RGBsy=\max(Rsy[i],Gsy[i],Bsy[i])$$

$$\min RGBsy=\min(Rsy[i],Gsy[i],Bsy[i])$$

B) Calculation of RGB Transmission Amounts (Rtsy[i], Gtsy[i], Btsy[i])

$$Rtsy[i]=Rsy[i]-Wtsy[i]$$

$$Gtsy[i]=Gsy[i]-Wtsy[i]$$

$$Btsy[i]=Bsy[i]-Wtsy[i]$$

C) Calculation of Backlight Value (Wbsy)

$$Wbsy=\max(Rtsy[1],Gtsy[1],Btsy[1],Wtsy[1],\ldots,$$

$$\mathrm{Rtsy[Np],Gtsy[Np],Btsy[Np],Wtsy[Np]})$$

D) Calculation of RGBW Transmittances (rsy[i], gsy[i], bsy[i], wsy[i])

$$rsy[i]=Rtsy[i]/Wbsy$$

$$gsy[i]=Gtsy[i]/Wbsy$$

$$bsy[i]=Btsy[i]/Wbsy$$

$$wsy[i]=Wtsy[i]/Wbsy$$

Note that when Wbsy=0, rsy[i]=gsy[i]=bsy[i]=wsy[i]=0.

As detailed above, in the liquid crystal display device of present embodiment 2, the chroma lowering processing and the luminance lowering processing are implemented on the input RGB signals (original inputs) before the output signal generating section 13 calculates the backlight value and the RGBW transmittances. This arrangement reliably lowers the backlight value.

Taking pixel B having (R, G, B)=(160, 256, 64) as an example, the backlight value equals 192 if no chroma lowering processing and no luminance lowering processing is preformed.

In contrast, if same pixel B is subjected to the chroma and luminance lowering processing where MAX=256, B1Ratios=0.625, and B1Ratioy=0.8, the pixel value of pixel B given by the chroma/luminance-lowered RGB signals is obtained as follows.

First, the chroma-lowering maximum backlight value MAXws is calculated by equation (10):

$$\mathrm{MAX}ws=\mathrm{MAX}\times B1\mathrm{Ratio}s=256\times 0.625=160$$

Next, the chroma-lowered RGB signals (Rs[1], Gs[1], Bs[1]) are calculated by equations (12) to (15):

$$\alpha s = \mathrm{MAX}ws / (\max RGB - \min RGB) = 160/(256-64) = 5/6$$

$$Y[1] = (2\times R[1] + 5\times G[1] + B[1])/8 = (2\times 160 + 5\times 256 + 64)/8 = 208$$

$$Rs[1] = \alpha s\times R[1] + (1-\alpha s)\times Y[1] = (5/6)\times 160 + (1-5/6)\times 208 = 168$$

$$Gs[1] = \alpha s\times G[1] + (1-\alpha s)\times Y[1] = (5/6)\times 256 + (1-5/6)\times 208 = 248$$

$$Bs[1] = \alpha s\times B[1] + (1-\alpha s)\times Y[1] = (5/6)\times 64 + (1-5/6)\times 208 = 88$$

Next, the luminance-lowering maximum backlight value MAXwsy after chroma lowering is calculated by equation (19):

$$\mathrm{MAX}wsy=\mathrm{MAX}ws\times B1\mathrm{Ratio}y=160\times 0.8=128$$

Next, the chroma/luminance-lowered RGB signals (Rsy[1], Gsy[1], Bsy[1]) are calculated by equations (21) to (24):

$$\beta sy = \mathrm{MAX}wsy/\max(\max RGB/2, \max RGB - \min RGB)$$
$$= 128/\max(248/2, 248 - 88) = 0.8$$

$$Rsy[1] = \beta sy \times Rs[1] = 0.8 \times 168 = 134$$
$$Gsy[1] = \beta sy \times Gs[1] = 0.8 \times 248 = 198$$
$$Bsy[1] = \beta sy \times Bs[1] = 0.8 \times 88 = 70$$

The backlight value is calculated as follows. First, the W transmission amount Wtsy[1] calculated by equation (28) as follows:

$$Wtsy[1] = \min(\max RGBsy/2, \min RGBsy)$$
$$= \min(198/2, 70) = 70$$

The RGB transmission amounts (Rtsy[1], Gtsy[1], Btsy [1]) is calculated by equations (29) to (31):

$$Rtsy[1]=Rsy[1]-Wtsy[1]=134-70=64$$

$$Gtsy[1]=Gsy[1]-Wtsy[1]=198-70=128$$

$$Btsy[1]=Bsy[1]-Wtsy[1]=70-70=0$$

Finally, the backlight value Wbsy is calculated by equation (32).

$$Wbsy = \max(Rtsy[1], Gtsy[1], Btsy[1], Wtsy[1])$$
$$= \max(64, 128, 0, 70) = 128$$

Hence, the luminance lowering processing lowers the backlight value from 192 to 128 (a reduction by about 33%).

Figure 1:
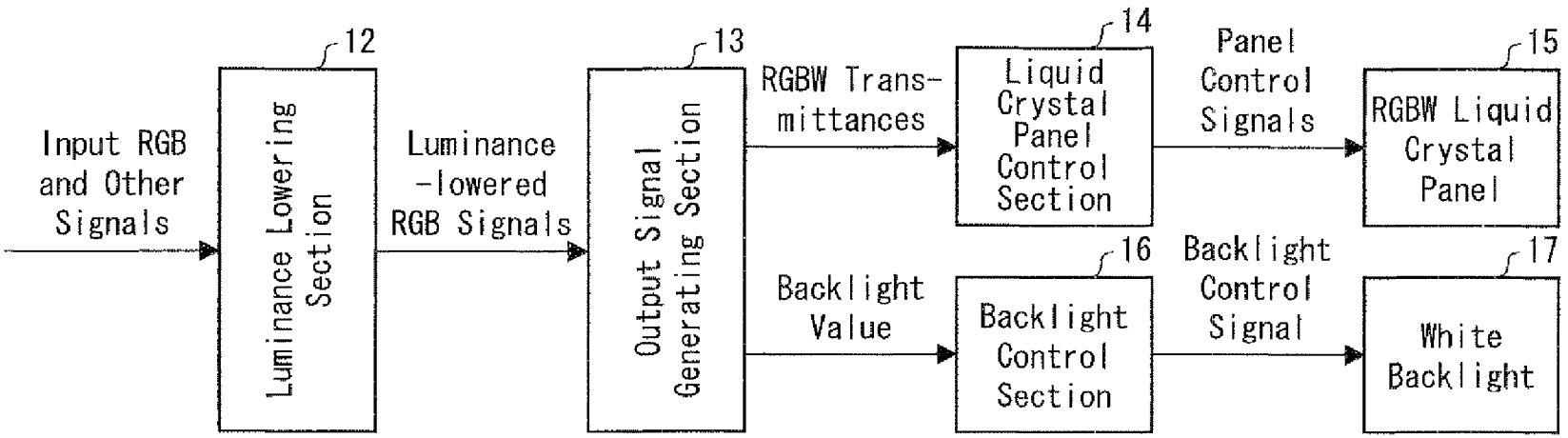
FIG. 1, relating to an embodiment of the present invention, is a block diagram of the configuration of a major part of a liquid crystal display device of embodiment 1.

The present liquid crystal display device basically is provided with a backlight 17 for a plurality of pixels. For example, the liquid crystal display device of FIG. 1 is an example of a configuration in which there is provided one white backlight 17 for the entire display screen of the liquid crystal panel 15. However, the present invention is by no means limited to this configuration. The display screen of the liquid crystal panel 15 may be divided into regions, and a plurality of backlights may be provided so that the backlight luminance is adjustable for each region.

Figure 13:
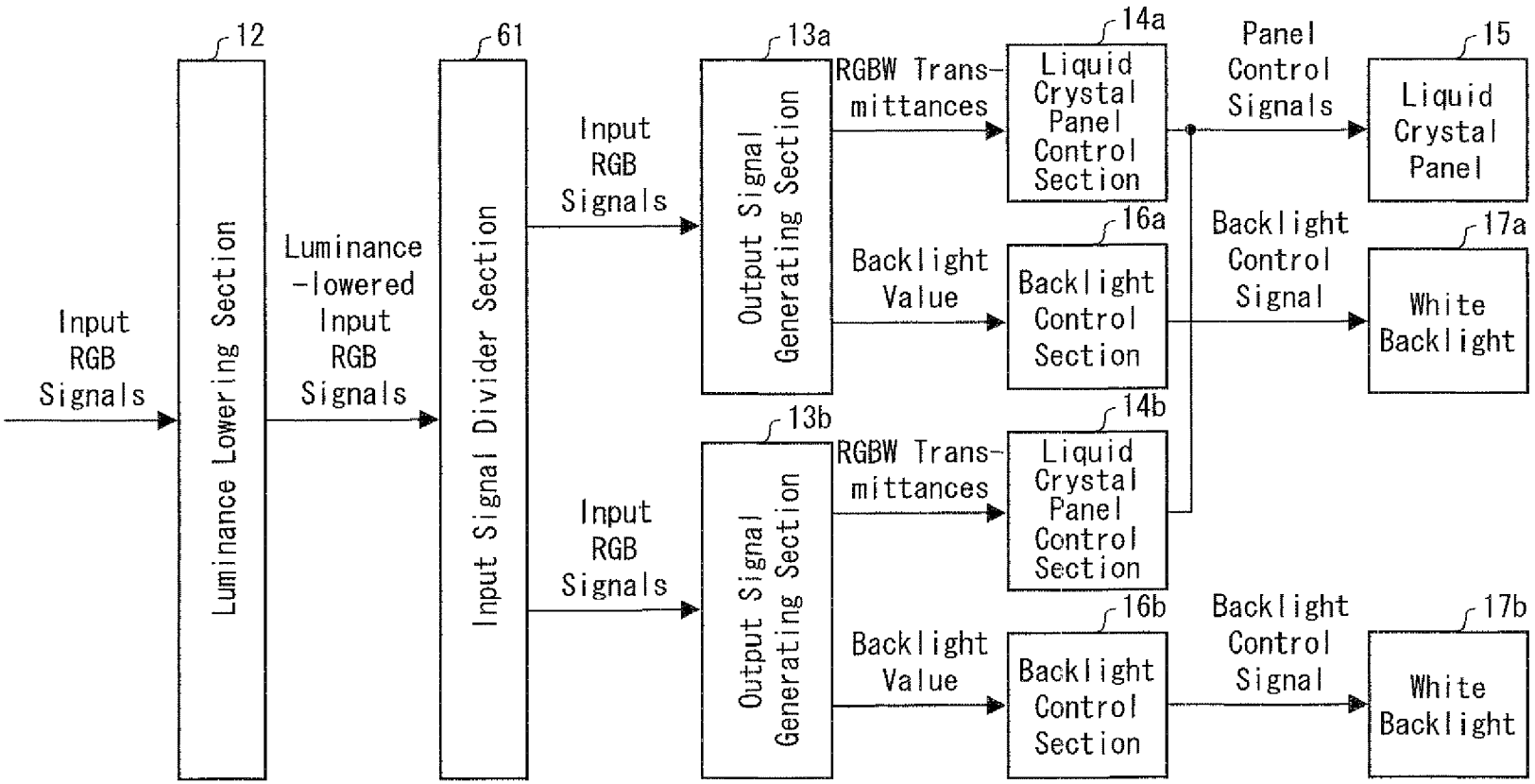
FIG. 13, relating to another embodiment of the present invention, is a block diagram of the configuration of a major part of a transmissive liquid crystal display device.

FIG. 13 shows an example in which two white backlights are provided for one display area. The number of backlights is however not limited.

The liquid crystal display device shown in FIG. 13 includes a luminance lowering section 12, an input signal divider section 61, output signal generating sections 13*a* and 13*b*, liquid crystal panel control sections 14*a* and 14*b*, a liquid crystal panel 15, backlight control sections 16*a* and 16*b*, and white backlights 17*a* and 17*b*.

The input signal divider section 61 divides the luminance-lowered input RGB signals for one screen fed from the luminance lowering section 12 to signals for two areas, for output to the input RGB signals covering the respective areas to the output signal generating sections 13*a* and 13*b*. The output signal generating sections 13*a* and 13*b* each perform equivalent processes on the associated area to the processes performed by the output signal generating section 13 of FIG. 1.

The liquid crystal panel control sections 14*a* and 14*b* performs equivalent processes on the associated area to the processes performed by the liquid crystal panel control section 14 of FIG. 1. Each control section controls the transmittances of pixels located in the associated area of the liquid crystal panel 15.

The backlight control sections 16*a* and 16*b* each perform equivalent processes on the associated area to the backlight control section 16 of FIG. 1. The white backlights 17*a* and 17*b* each have the same structure as the backlight 17. Each backlight illuminates the associated area.

As detailed above, the backlight value can be further reduced by dividing a screen into plurality of areas and controlling for each area. The present embodiment divides a screen into two areas. The screen may divided into three or more areas for control.

Images generally contain similar colors in adjacent segments. The division of backlight region as in the arrangement of FIG. 13 enables the backlight to be darkened for the backlight region containing many dark pixels. As a result, dividing the backlight can better reduce overall backlight power consumption than not dividing the backlight.

The processes implemented by the luminance lowering section 12 and the output signal generating section 13 may be instead implemented by software executable by a personal computer. The following will describe procedures for software implementation of the processes.

Figure 14:
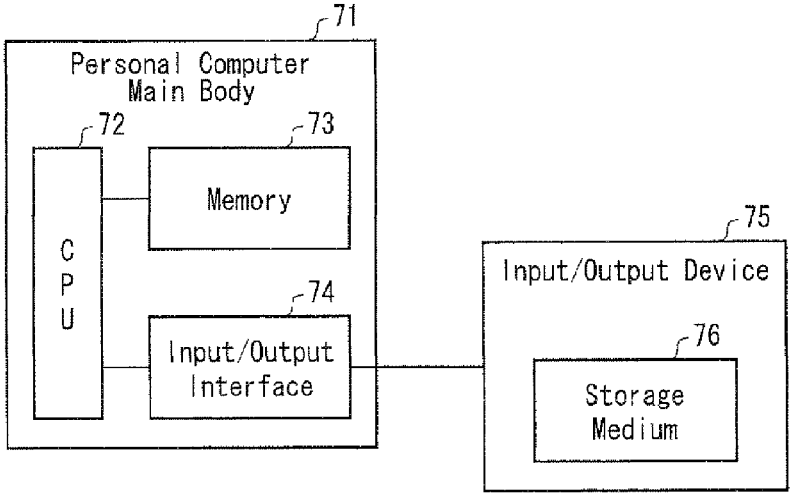
FIG. 14 illustrates a system configuration for software implementation of the display control of the present invention.

FIG. 14 illustrates a system configuration for software implementation of the processes. The system includes a personal computer main body 71 and an input/output device 75. The personal computer main body 71 includes a CPU 72, a memory 73, and an input/output interface 74. The input/output device 75 includes a storage medium 76.

The CPU 72 first controls the input/output device 75 via the input/output interface 74 to read a luminance lowered/output signal generation program, a parameter file (maximum values of the input RGB signals, backlight value setup ratio, area information used in dividing a screen into a plurality of areas, etc.), and input image data from the storage medium 76 and store the program, file, data, etc. in the memory 73.

Furthermore, the CPU 72 reads in the luminance lowered/output signal generation program, the parameter file, and the input image data from the memory 73 and lowers luminance and generates output signals from the input image data supplied, according to the instructions from the luminance lowered/output signal generation program. Thereafter, the CPU 72 controls the input/output device 75 via the input/output interface 74 and outputs the backlight value and the RGBW transmittances after generation of output signals to the storage medium 76.

Figure 15:
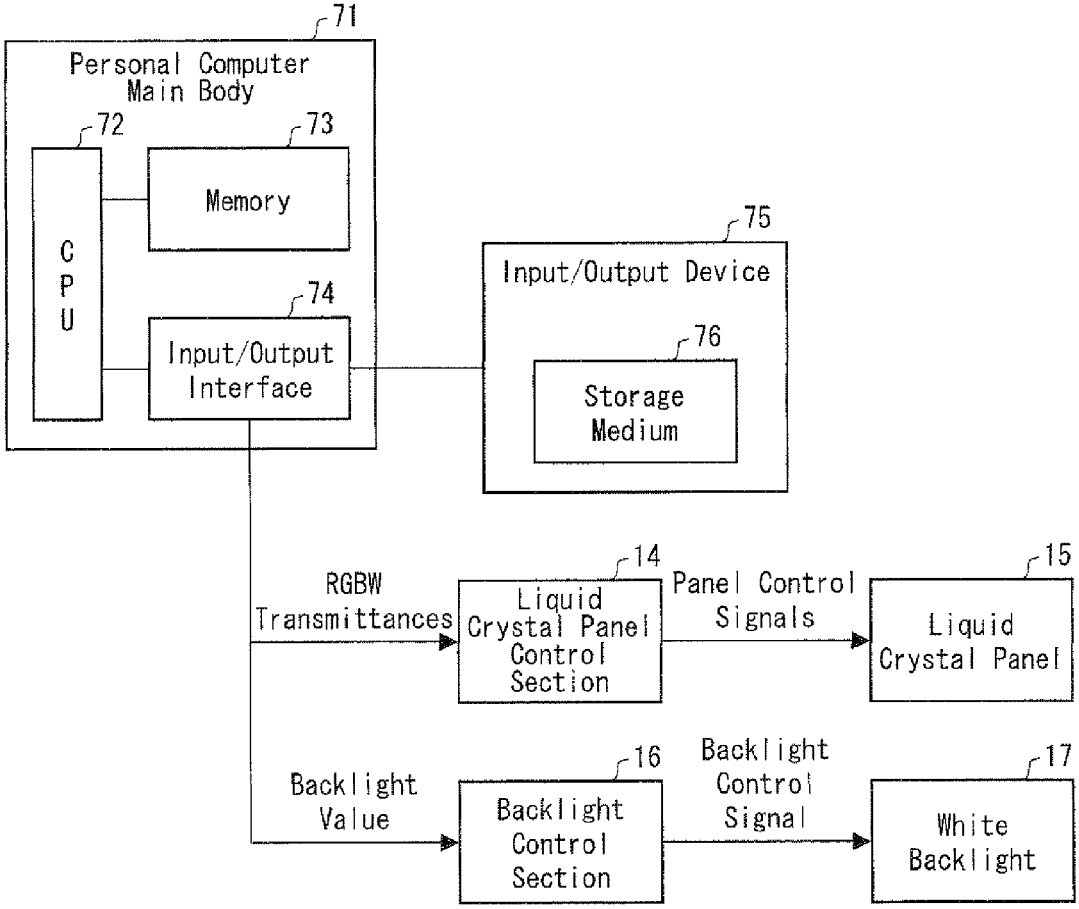
FIG. 15 illustrates a variation of the system configuration for software implementation of the display control of the present invention.
Figure 16:
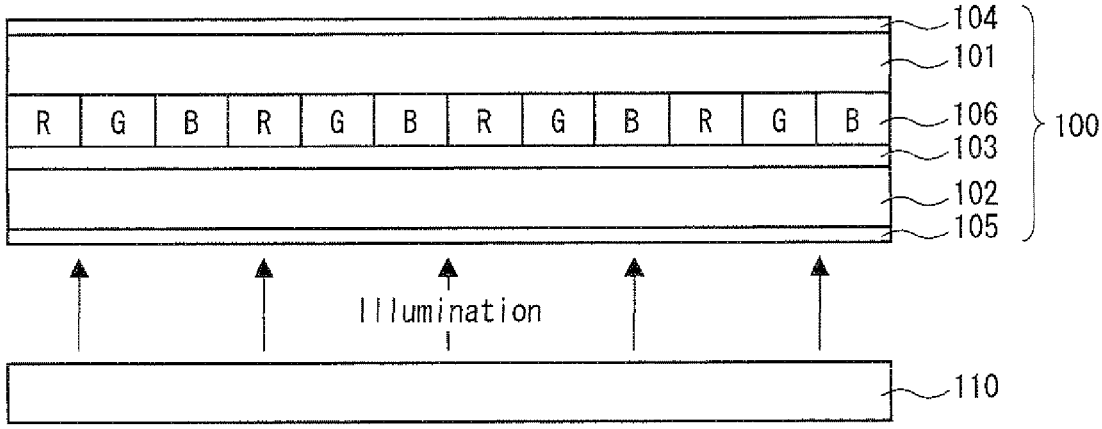
FIG. 16 is a cross-sectional view of a typical structure of a transmissive liquid crystal display device.
Figure 17:
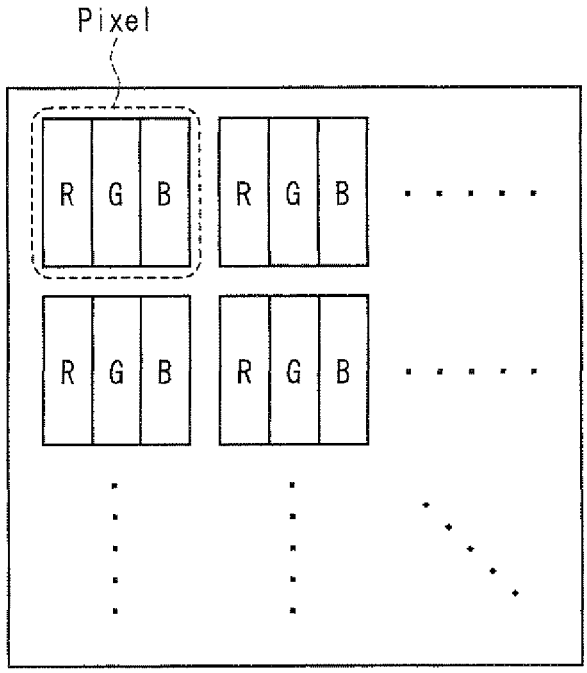
FIG. 17 represents a typical layout example of subpixels in a transmissive liquid crystal display device.

Alternatively, as shown in FIG. 15, the backlight value and the RGBW transmittances after generation of output signals are output via the input/output interface 74 to the backlight control section 16 and the liquid crystal panel control section 14 respectively. The outputs enables controlling the white backlight 17 and the liquid crystal panel 15 to actually display an image.

As detailed above, the system is capable of lowering luminance and generating output signals on the personal computer as explained above. That enables verification of the luminance lowering method and output signal generation method and demonstration of backlight value lowering before actually making a prototype of the luminance lowering section and the output signal generating section.

The description associated with FIGS. 14 and 15 is an example of software implementation on a personal computer of the calculation of the luminance-lowered input RGB signals, the backlight value, and the RGBW transmittances which is performed by the luminance lowering section 12 and the output signal generating section 13 in embodiment 1.

However, in the present invention, the calculation of the chroma-lowered input RGB signals, the chroma/luminance-lowered input RGB signals, the backlight value, and the RGBW transmittances which is performed by the chroma lowering section 11, the luminance lowering section 12, and the output signal generating section 13 of embodiment 2 may be implemented by software executable by on a personal computer.

The present invention is not limited to the description of the embodiments above, but may be altered by a skilled person within the scope of the claims. An embodiment based on a proper combination of technical means disclosed in different embodiments is encompassed in the technical scope of the present invention.

What is claimed is:

1. A transmissive liquid crystal display device, comprising:

a liquid crystal panel containing pixels each divided into four subpixels, a red (R), a green (G), a blue (B), and a white (W) subpixel;

a white active backlight emitting light with controllable emission luminance;

a luminance lowering section for performing luminance lowering processing on high luminance pixel data of pixel data contained in input RGB signals representing an input image to transform the input RGB signals to luminance-lowered RGB signals:

an output signal generating section for generating transmittance signals for individual R, G, B, W subpixels in the pixels in the liquid crystal panel from the luminance-lowered RGB signals and also calculating a backlight value for the active backlight from the luminance-lowered RGB signals;

a liquid crystal panel control section for controlling driving of the liquid crystal panel according to the transmittance signals generated in the output signal generating section;

a backlight control section for controlling the emission luminance of the backlight according to the backlight value calculated in the output signal generating section;

wherein the luminance lowering section performs the luminance lowering processing by following procedures (A) to (B):

(A) calculating a luminance-lowering maximum backlight value MAXwy by equation (1), $$MAXwy=MAX\times B1Ratioy \quad (1)$$

where MAX is a maximum value of the input RGB signals (i.e., the maximum one of backlight values when neither chroma lowering nor luminance lowering is preformed) and B1Ratioy is a luminance-lowering backlight value setup ratio ($0\leqq B1Ratioy\leqq 1$), (B) transforming the input RGB signals (R[i], G[i], B[i]) to the luminance-lowered RGB signals (Ry[i], Gy[i], By[i]) (i=1, 2, . . . , Np; Np is the number of pixels in the image) by if inequality (2) is satisfied, calculating the luminance-lowered-RGB signals by equations (3) to (6), $$MAXwy<\max(maxRGB/2, maxRGB-minRGB) \quad (2)$$

$$Ry[i]=\beta y\times R[i] \quad (3)$$

$$Gy[i]=\beta y\times G[i] \quad (4)$$

$$By[i]=\beta y\times B[i] \quad (5)$$

$$\beta y=MAXwy/\max(maxRGB/2, maxRGB-minRGB) \quad (6)$$

where maxRGB=max(R[i], G[i], B[i]), minRGB=min(R[i], G[i], B[i]), max(A, B, . . . ) is a maximum value of A, B, . . . , and min (A, B, . . . ) is a minimum value of A, B, . . . , and if inequality (2) is not satisfied, transforming the luminance-lowered RGB signals to similar levels to the input RGB signals by equations (7) to (9)

$$Ry[i]=R[i] \quad (7)$$

$$Gy[i]=G[i] \quad (8)$$

$$By[i]=B[i] \quad (9).$$

2. A transmissive liquid crystal display device, comprising:

a liquid crystal panel containing pixels each divided into four subpixels, a red (R), green (G), a blue (B), and a white (W) subpixel;

a white active backlight emitting light with controllable emission luminance;

a chroma lowering section for performing chroma lowering processing on high luminance, high chroma pixel data of pixel data contained in input RGB signals representing an input image to transform the input RGB signals to chroma-lowered RGB signals;

a luminance lowering section for performing luminance lowering processing on high luminance pixel data of pixel data contained in the chroma-lowered RGB signals to transform the chroma-lowered RGB signals to chroma/luminance-lowered RGB signals;

an output signal generating section for generating transmittance signals for individual R, G, B, W subpixels in the pixels in the liquid crystal panel from the chroma/luminance-lowered RGB signals and also calculating a backlight value for the active backlight from the chroma/luminance-lowered RGB signals;

a liquid crystal panel control section for controlling driving of the liquid crystal panel according to the transmittance signals generated in the output signal generating section;

a backlight control section for controlling the emission luminance of the backlight according to the backlight value calculated in the output signal generating section;

wherein the chroma lowering section performs the chroma lowering processing by following procedures (A) to (B), and the luminance lowering section performs the luminance lowering processing by following procedures (C) to (D), (A) calculating a chroma-lowering maximum backlight value MAXws by equation (10), $$MAXws=MAX\times B1Ratios \quad (10)$$

where MAX is a maximum value of the input RGB signals (i.e., the maximum one of backlight values when neither chroma lowering nor luminance lowering is preformed) and B1Ratios is a chroma-lowering backlight value setup ratio ($0.5\leqq B1Ratios\leqq 1.0$), (B) transforming the input RGB signals (R[i], G[i], B[i]) to the chroma-lowered RGB signals (Rs[i], Gs[i], Bs[i]) by if inequality (11) is satisfied, calculating the chroma-lowered RGB signals by equations (12) to (15), $$MAXws<maxRGB-minRGB \quad (11)$$

$$Rs[i]=\alpha s\times R[i]+(1-\alpha s)\times Y[i] \quad (12)$$

$$Gs[i]=\alpha s\times G[i]+(1-\alpha s)\times Y[i] \quad (13)$$

$$Bs[i]=\alpha s\times B[i]+(1-\alpha s)\times Y[i] \quad (14)$$

$$\alpha s=MAXws/(maxRGB-minRGB) \quad (15)$$

where Y[i] is a luminance of the input RGB signals (R[i], G[i], B[i]),

If inequality (11) is not satisfied, transforming the chroma-lowered RGB signals to similar levels to the input RGB signals by equations (16) to (18)

$$Rs[i]=R[i] \quad (16)$$

$$Gs[i]=G[i] \quad (17)$$

$$Bs[i]=B[i] \quad (18)$$

(C) calculating a luminance-lowering maximum backlight value MAXwsy by equation (19), $$MAXwsy=MAXws\times B1Ratioy \quad (19)$$

(D) transforming the chroma-lowered RGB signals (Rs[i], Gs[i], Bs[i]) to the chroma/luminance-lowered RGB signals (Rsy[i], Gsy[i], Bsy[i]) by if inequality (20) is satisfied, calculating the chroma/luminance-lowered RGB signals by equations (21) to (24), $$MAXwsy<\max(maxRGBs/2,maxRGBs-minRGBs) \quad (20)$$

$$Rsy[i]=\beta sy\times Rs[i] \quad (21)$$

$$Gsy[i]=\beta sy\times Gs[i] \quad (22)$$

$$Bst[i]=\beta sy\times Bs[i] \quad (23)$$

$$\beta sy=MAXwsy/\max(maxRGBs/2, maxRGBs-minRGBs) \quad (24)$$

where maxRGBs=max(Rs[i], Gs[i], Bs[i]) and minRGBs=min(Rs[i], Gs[i], Bs[i]), if inequality (20) is not satisfied, transforming the chroma/luminance-lowered RGB signals to similar levels to the chroma-lowered RGB signals by equations (25) to (27)

$$Rsy[i]=Rs[i] \quad (25)$$

$$Gsy[i]=Gs[i] \quad (26)$$

$$Bsy[i]=Bs[i] \quad (27).$$

3. The transmissive liquid crystal display device according to claim 1, wherein the luminance lowering section maintains chroma and hue unchanged in transforming the input RGB signals to the luminance-lowered RGB signals.

4. The transmissive liquid crystal display device according to claim 2, wherein the luminance lowering section maintains chroma and hue unchanged in transforming the chroma-lowered RUB signals to the chroma/luminance-lowered RGB signals.

5. The transmissive liquid crystal display device according to claim 1, wherein the luminance lowering section is capable of altering how far the luminance lowering processing should be implemented.

6. The transmissive liquid crystal display device according to claim 2, wherein the luminance lowering section is capable of altering how far the luminance lowering processing should be implemented.

7. The transmissive liquid crystal display device according to claim 1, wherein the output signal generating section contains:

a W transmission amount calculation section for calculating transmission amounts (Wty[i]) for the W subpixels by procedure (A);

an RGB transmission amount calculation section for calculating transmission amounts (Rty[i], Gty[i], Bty[i]) for the individual RGB subpixels by procedure (B);

a backlight value calculation section for calculating the backlight value (Wby) by procedure (C); and a transmittance calculation section for calculating transmittances (ry[i], gy[i], by[i], wy[i]) for the RGBW subpixels by procedure (D), (A) calculating W transmission amounts (Wty[i]) by equation (28)

$$Wty[i]=\min(maxRGBy/2,minRGBy) \quad (28)$$

where maxRGBy=max(Ry[i], Gy[i], By[i]) and minRGBy=min(Ry[i], Gy[i], By[i]), (B) calculating RGB transmission amounts (Rty[i], Gty[i], Bty[i]) by equations (29) to (31)

$$Rty[i]=Ry[i]-Wty[i] \quad (29)$$

$$Gty[i]=Gy[i]-Wty[i] \quad (30)$$

$$Bty[i]=By[i]-Wty[i] \quad (31)$$

(C) calculating the backlight value Wby by equation (32)

$$Wby=\max(Rty[1],Gty[1],Bty[1],Wty[1], \ldots, Rty[Np], Gty[Np],Bty[Np], Wty[Np]) \quad (32)$$

(D) calculating RGBW transmittances (ry[i], gy[i], by[i], wy[i]) by equations (33) to (36)

$$ry[i]=Rty[i]/Wby \quad (33)$$

$$gy[i]=Gty[i]/Wby \quad (34)$$

$$by[i]=Bty[i]/Wby \quad (35)$$

$$wy[i]=Wty[i]/Wby \quad (36)$$

where ry[i]=gy[i]=by[i]=wy[i]=0 when Wby=0.

8. The transmissive liquid crystal display device according to claim 2, wherein the output signal generating section contains:

a W transmission amount calculation section for calculating transmission amounts (Wtsy[i]) for the W subpixels by procedure (A);

an RGB transmission amount calculation section for calculating transmission amounts (Rtsy[i], Gtsy[i], Btsy[i]) for the individual ROB subpixels by procedure (B);

a backlight value calculation section for calculating the backlight value (Wbsy) by procedure (C); and a transmittance calculation section for calculating transmittances (rsy[i], gsy[i], bsy[i], wsy[i]) for the RGBW subpixels by procedure (D), (A) calculating W transmission amounts (Wtsy[i]) by equation (28)

$$Wtsy[i]=\min(maxRGBsy/2,minRGBsy) \quad (28)$$

where maxRGBsy=max(Rsy[i], Gsy[i], Bsy[i]) and minRGBsy=min(Rsy[i], Gsy[i], Bsy[i]), (B) calculating RGB transmission amounts (Rtsy[i], Gtsy[i], Btsy[i]) by equations (29) to (31)

$$Rtsy[i]=Rsy[i]-Wtsy[i] \quad (29)$$

$$Gtsy[i]=Gsy[i]-Wtsy[i] \quad (30)$$

$$Btsy[i]=Bsy[i]-Wtsy[i] \quad (31)$$

(C) calculating the backlight value Wbsy by equation (32)

$$Wbsy=\max(Rtsy[1],Gtsy[1],Btsy[1],Wtsy[1], \ldots, Rtsy[Np], Gtsy[Np],Btsy[Np],Wtsy[Np]) \quad (32)$$

(D) calculating RGBW transmittances (rsy[i], gsy[i], bsy[i], wsy[i]) by equations (33) to (36)

$$rsy[i]=Rtsy[i]/Wbsy \quad (33)$$

$$gsy[i]=Gtsy[i]/Wbsy \quad (34)$$

$$bsy[i]=Btsy[i]/Wbsy \quad (35)$$

$$wsy[i]=Wtsy[i]/Wbsy \quad (36)$$

where rsy[i]=gsy[i]=bsy[i]=wy[i]=0 when Wbsy=0.

9. The transmissive liquid crystal display device according to claim 1, comprising a plurality of said active backlights for the liquid crystal panel, wherein transmittance control for the liquid crystal panel and backlight value control for the backlights are performed for each of regions corresponding respectively to said active backlights.

10. The transmissive liquid crystal display device according to claim 2, comprising a plurality of said active backlights for the liquid crystal panel, wherein transmittance control for the liquid crystal panel and backlight value control for the backlights are performed for each of regions corresponding respectively to said active backlights.

11. A non-transitory storage medium containing a control program causing a computer to perform processing carried out by said functional sections of claim 1.

12. A non-transitory storage medium containing a control program causing a computer to perform processing carried out by said functional sections of claim 2.

13. A non-transitory storage medium containing a control program causing a computer to perform processing carried out by said functional sections of claim 7.

14. A non-transitory storage medium containing a control program causing a computer to perform processing carried out by said functional sections of claim 8.

* * * * *